US012485322B2

(12) United States Patent
Stites et al.

(10) Patent No.: US 12,485,322 B2
(45) **Date of Patent: *Dec. 2, 2025**

(54) GOLF CLUB HEAD OR OTHER BALL STRIKING DEVICE HAVING ONE OR MORE FACE CHANNELS

(71) Applicant: KARSTEN MANUFACTURING CORPORATION, Phoenix, AZ (US)

(72) Inventors: John T. Stites, Sallisaw, OK (US); Andrew G.V. Oldknow, Beaverton, OR (US); Philip J. Hatton, Portland, OR (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/470,360

(22) Filed: Sep. 19, 2023

(65) Prior Publication Data

US 2024/0001205 A1 Jan. 4, 2024

Related U.S. Application Data

(63) Continuation of application No. 17/643,130, filed on Dec. 7, 2021, now Pat. No. 11,759,683, which is a continuation of application No. 16/546,127, filed on Aug. 20, 2019, now Pat. No. 11,192,004, which is a continuation of application No. 15/583,677, filed on (Continued)

(51) Int. Cl.

| | |
|---|---|
| ***A63B 53/04*** | (2015.01) |
| ***A63B 60/42*** | (2015.01) |
| ***A63B 60/52*** | (2015.01) |

(52) U.S. Cl.

CPC ..... *A63B 53/047* (2013.01); *A63B 53/0466* (2013.01); *A63B 60/42* (2015.10); *A63B 60/52* (2015.10); *A63B 53/0412* (2020.08); *A63B 53/0416* (2020.08); *A63B 53/0433* (2020.08);

(Continued)

(58) Field of Classification Search

CPC ... A63B 53/047; A63B 60/52; A63B 53/0416; A63B 53/0445

See application file for complete search history.

(56) References Cited

U.S. PATENT DOCUMENTS

| | | | |
|---|---|---|---|
| 2,004,968 | A | 6/1935 | Young |
| 2,005,401 | A | 6/1935 | Storz |

(Continued)

FOREIGN PATENT DOCUMENTS

| | | |
|---|---|---|
| JP | H07313639 | 12/1995 |
| JP | H08-777 | 1/1996 |

(Continued)

OTHER PUBLICATIONS

International Search Report and Written Opinion dated Feb. 12, 2010 for PCT Application No. PCT/US2010/043862, filed Jul. 30, 2010.

*Primary Examiner* — William M Pierce

(57) ABSTRACT

A ball striking device, such as a golf club, includes a head with a face having a ball-striking surface configured for striking a ball, a body connected to the face, and at least one channel in the ball-striking surface of the face. The region of highest COR response of the face is directionally enlarged toward the channel. Depending on the size, shape, and location of the channel, the face can be altered to provide greater COR response and increased energy transfer for impacts at specific locations on the face.

20 Claims, 20 Drawing Sheets

Related U.S. Application Data

May 1, 2017, now Pat. No. 10,420,992, which is a continuation of application No. 14/478,207, filed on Sep. 5, 2014, now Pat. No. 9,636,555, which is a continuation of application No. 13/336,487, filed on Dec. 23, 2011, now Pat. No. 8,827,826, which is a continuation of application No. 12/537,058, filed on Aug. 6, 2009, now Pat. No. 8,083,612.

(52) U.S. Cl.
CPC ..... *A63B 53/0437* (2020.08); *A63B 53/0445* (2020.08)

(56) References Cited

U.S. PATENT DOCUMENTS

| | | | |
|---|---|---|---|
| 2,034,936 | A | 3/1936 | Barnhart |
| D193,098 | S | 6/1962 | Davis |
| 5,090,702 | A | 2/1992 | Viste |
| 5,358,249 | A | 10/1994 | Mendralla |
| 5,564,705 | A | 10/1996 | Kobayashi |
| 5,643,099 | A | 7/1997 | Solheim |
| 5,676,605 | A | 10/1997 | Kobayashi |
| 5,688,187 | A | 11/1997 | Duncan |
| 5,807,187 | A | 9/1998 | Hamm |
| 6,001,027 | A | 12/1999 | Hansberger |
| 6,030,295 | A | 2/2000 | Takeda |
| 6,042,486 | A | 3/2000 | Gallagher |
| 6,299,548 | B1 | 10/2001 | Lin |
| 6,306,048 | B1 | 10/2001 | McCabe |
| 6,309,310 | B1 | 10/2001 | Shira |
| 6,322,459 | B1 | 11/2001 | Nishimura |
| 6,348,013 | B1 | 2/2002 | Kosmatka |
| 6,398,665 | B1 | 6/2002 | Antonious |
| 6,471,602 | B1 | 10/2002 | D'Orazio |
| 6,659,885 | B1 | 12/2003 | Knuth |
| 6,695,714 | B1 | 2/2004 | Bliss |
| 6,729,971 | B2 | 5/2004 | Caldwell |
| 7,169,062 | B2 | 1/2007 | Chen |
| 7,261,643 | B2 | 8/2007 | Rice |
| 7,462,112 | B1 | 12/2008 | Sung |
| 7,594,862 | B2 | 9/2009 | Gilbert |
| 7,614,964 | B2 | 11/2009 | Matsunaga |
| 7,618,331 | B2 | 11/2009 | Hirano |
| 8,449,406 | B1 | 5/2013 | Frame |
| 8,475,293 | B2 | 7/2013 | Morin |
| 8,826,512 | B2 | 9/2014 | Schweigert |
| D716,388 | S | 10/2014 | Aguayo |
| 8,961,336 | B1 | 2/2015 | Parsons |
| 9,033,818 | B2 | 5/2015 | Myrhum |
| 9,283,449 | B1 | 3/2016 | Demille |
| D756,475 | S | 5/2016 | Ripp |
| 9,492,722 | B2 | 11/2016 | Taylor |
| 9,636,555 | B2 | 5/2017 | Stites |
| 9,636,757 | B1 | 5/2017 | Rice |
| 9,802,091 | B2 | 10/2017 | Taylor |
| 9,844,709 | B2 | 12/2017 | Tassistro |
| 9,878,219 | B2 | 1/2018 | Shimahara |
| 9,901,789 | B2 | 2/2018 | Kitagawa |
| 9,901,792 | B2 | 2/2018 | Franklin |
| 9,937,389 | B2 | 4/2018 | Kitagawa |
| 9,937,395 | B2 | 4/2018 | Taylor |
| 9,975,017 | B2 | 5/2018 | Simone |
| 9,975,022 | B2 | 5/2018 | Boggs |
| 10,046,211 | B2 | 8/2018 | Franklin |
| 10,052,533 | B1 | 8/2018 | Kuc |
| 10,434,383 | B2 | 10/2019 | Aguayo |
| 10,537,772 | B2 | 1/2020 | Stephens |
| 10,780,328 | B1 | 9/2020 | Beno |
| 2002/0049095 | A1 | 4/2002 | Galloway |
| 2002/0091015 | A1 | 7/2002 | Seki |
| 2005/0101404 | A1 | 5/2005 | Long |
| 2005/0119070 | A1 | 6/2005 | Kumamoto |
| 2005/0124435 | A1 | 6/2005 | Gambetta |
| 2005/0192117 | A1 | 9/2005 | Knuth |
| 2006/0052177 | A1 | 3/2006 | Nakahara |
| 2006/0073906 | A1 | 4/2006 | Chen |
| 2007/0010346 | A1 | 1/2007 | Gilbert |
| 2007/0026961 | A1 | 2/2007 | Hou |
| 2007/0049417 | A1 | 3/2007 | Shear |
| 2007/0082752 | A1 | 4/2007 | Boyd |
| 2008/0020859 | A1 | 1/2008 | Yamagishi |
| 2008/0051220 | A1 | 2/2008 | Soracco |
| 2008/0125242 | A1 | 5/2008 | Ban |
| 2008/0125243 | A1 | 5/2008 | Ban |
| 2008/0132351 | A1 | 6/2008 | Ban |
| 2008/0132352 | A1 | 6/2008 | Ban |
| 2008/0167138 | A1 | 7/2008 | Ban |
| 2008/0261720 | A1 | 10/2008 | Matsunaga |
| 2009/0156328 | A1 | 6/2009 | Reese |
| 2009/0163292 | A1 | 6/2009 | Chao |
| 2009/0318243 | A1 | 12/2009 | Golden |
| 2010/0087269 | A1 | 4/2010 | Snyder |
| 2010/0087270 | A1 | 4/2010 | Ban |
| 2010/0304884 | A1 | 12/2010 | Nakamura |
| 2011/0111883 | A1 | 5/2011 | Cackett |
| 2011/0172026 | A1 | 7/2011 | Cackett |
| 2011/0269568 | A1 | 11/2011 | Ban |
| 2012/0135821 | A1 | 5/2012 | Boyd |
| 2013/0217513 | A1 | 8/2013 | Amano |
| 2013/0225319 | A1 | 8/2013 | Kato |
| 2013/0288820 | A1 | 10/2013 | Shimahara |
| 2013/0324281 | A1 | 12/2013 | Boyd |
| 2014/0206472 | A1 | 7/2014 | Aguayo |
| 2014/0206473 | A1 | 7/2014 | Ripp |
| 2015/0024868 | A1 | 1/2015 | Simone |
| 2015/0231454 | A1 | 8/2015 | Parsons |
| 2015/0231806 | A1 | 8/2015 | Parsons |
| 2015/0360091 | A1 | 12/2015 | Ban |
| 2016/0008677 | A1 | 1/2016 | Kitagawa |
| 2016/0008678 | A1 | 1/2016 | Kitagawa |
| 2016/0361607 | A1 | 12/2016 | Huang |
| 2017/0333766 | A1 | 11/2017 | Ban |
| 2018/0028882 | A1 | 2/2018 | Hebreo |
| 2018/0133566 | A1 | 5/2018 | Kitagawa |
| 2019/0224533 | A1 | 7/2019 | Spackman |

FOREIGN PATENT DOCUMENTS

| | | |
|---|---|---|
| JP | 10-263118 | 6/1998 |
| JP | H10314349 | 12/1998 |
| JP | 2002119626 | 4/2002 |
| JP | 2002253713 | 9/2002 |
| JP | 2003024485 | 1/2003 |
| JP | 2006212092 | 8/2006 |
| JP | 2007301016 | 11/2007 |
| JP | 2007301017 | 11/2007 |
| JP | 2008006296 | 1/2008 |

FIG. 25
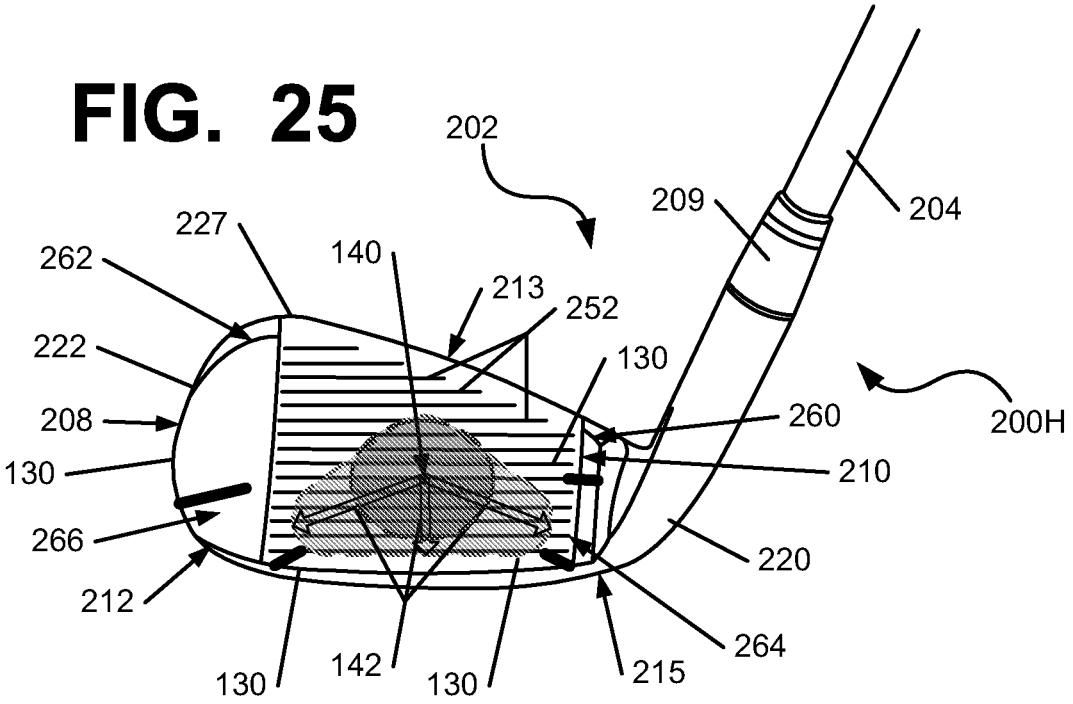
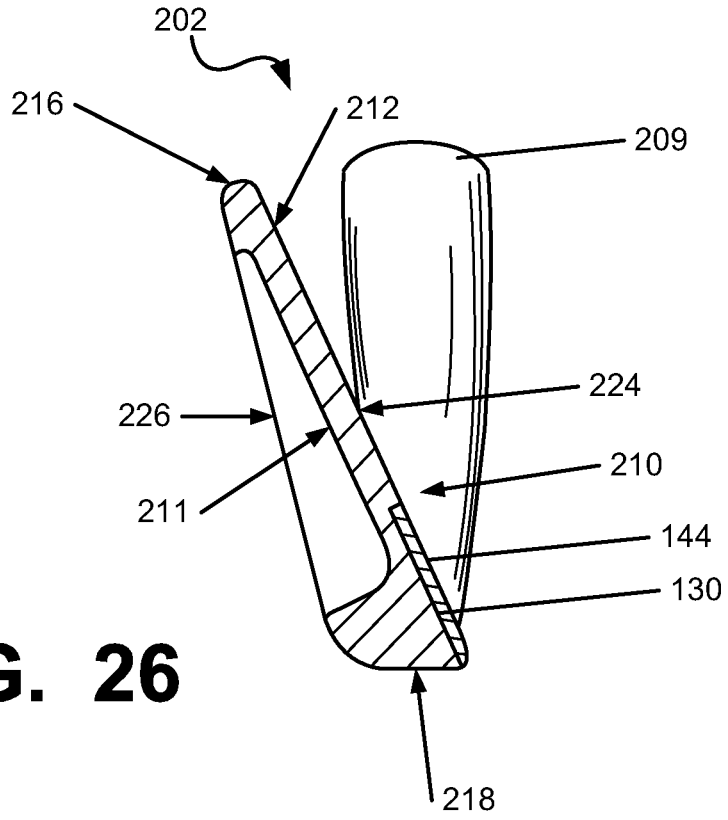
FIG. 26

GOLF CLUB HEAD OR OTHER BALL STRIKING DEVICE HAVING ONE OR MORE FACE CHANNELS

CROSS-REFERENCE TO RELATED APPLICATION

This is a continuation of U.S. patent application Ser. No. 17/643,130, filed Dec. 7, 2021, now U.S. Pat. No. 11,759,683, issued on Sep. 19, 2023 which is a continuation of U.S. patent application Ser. No. 16/546,127, filed Aug. 20, 2019, now U.S. Pat. No. 11,192,004, issued on Dec. 7, 2021, which is a continuation of U.S. patent application Ser. No. 15/583,677, filed May 1, 2017, now U.S. Pat. No. 10,420,992 issued on Sep. 24, 2019, which is a continuation of U.S. patent application Ser. No. 14/478,207, filed Sep. 5, 2014, now U.S. Pat. No. 9,636,555, issued on May 2, 2017, which is a continuation of U.S. patent application Ser. No. 13/336,487, filed Dec. 23, 2011, now U.S. Pat. No. 8,827,826, issued on Sep. 9, 2014, which is a continuation of U.S. patent application Ser. No. 12/537,058, filed Aug. 6, 2009, now U.S. Pat. No. 8,083,612, issued on Dec. 27, 2011. The contents of all disclosures above are incorporated fully herein by reference.

TECHNICAL FIELD

The invention relates generally to ball striking devices, such as golf club heads, having at least one face channel. Certain aspects of this invention relate to golf club heads having one or more channels in the ball striking face, changing the flexibility of the face.

BACKGROUND

Golf is enjoyed by a wide variety of players—players of different genders, and players of dramatically different ages and skill levels. Golf is somewhat unique in the sporting world in that such diverse collections of players can play together in golf outings or events, even in direct competition with one another (e.g., using handicapped scoring, different tee boxes, etc.), and still enjoy the golf outing or competition. These factors, together with increased golf programming on television (e.g., golf tournaments, golf news, golf history, and/or other golf programming) and the rise of well known golf superstars, at least in part, have increased golf s popularity in recent years, both in the United States and across the world.

Golfers at all skill levels seek to improve their performance, lower their golf scores, and reach that next performance "level." Manufacturers of all types of golf equipment have responded to these demands, and recent years have seen dramatic changes and improvements in golf equipment. For example, a wide range of different golf ball models now are available, with some balls designed to fly farther and straighter, provide higher or flatter trajectory, provide more spin, control, and feel (particularly around the greens), etc.

Being the sole instrument that sets a golf ball in motion during play, the golf club also has been the subject of much technological research and advancement in recent years. For example, the market has seen improvements in golf club heads, shafts, and grips in recent years. Additionally, other technological advancements have been made in an effort to better match the various elements of the golf club and characteristics of a golf ball to a particular user's swing features or characteristics (e.g., club fitting technology, ball launch angle measurement technology, etc.).

Despite the various technological improvements, golf remains a difficult game to play at a high level. For a golf ball to reliably fly straight and in the desired direction, a golf club must meet the golf ball square (or substantially square) to the desired target path. Moreover, the golf club must meet the golf ball at or close to a desired location on the club head face (i.e., on or near a "desired" or "optimal" ball contact location) to reliably fly straight, in the desired direction, and for a desired distance. Off-center hits may tend to "twist" the club face when it contacts the ball, thereby sending the ball in the wrong direction, imparting undesired hook or slice spin, and/or robbing the shot of distance. Club face/ball contact that deviates from squared contact and/or is located away from the club's desired ball contact location, even by a relatively minor amount, also can launch the golf ball in the wrong direction, often with undesired hook or slice spin, and/or can rob the shot of distance. Accordingly, club head features that can help a user keep the club face square with the ball would tend to help the ball fly straighter and truer, in the desired direction, and often with improved and/or reliable distance.

Various golf club heads have been designed to improve a golfer's accuracy by assisting the golfer in squaring the club head face at impact with a golf ball. When the club face is not square at the point of engagement, the golf ball may fly in an unintended direction and/or may follow a route that curves left or right, ball flights that are often referred to as "pulls," "pushes," "draws," "fades," "hooks," or "slices," or may exhibit more boring or climbing trajectories.

Many off-center golf hits are caused by common errors in swinging the golf club that are committed repeatedly by the golfer, and which may be similarly committed by many other golfers. As a result, patterns can often be detected, where a large percentage of off-center hits occur in certain areas of the club face. For example, one such pattern that has been detected is that many high handicap golfers tend to hit the ball on the low-heel area of the club face and/or on the high-toe area of the club face. Other golfers may tend to miss in other areas of the club face. Because golf clubs are typically designed to contact the ball at or around the center of the face, such off-center hits may result in less energy being transferred to the ball, decreasing the distance of the shot. The energy or velocity transferred to the ball by a golf club also may be related, at least in part, to the flexibility of the club face at the point of contact, and can be expressed using a measurement called "coefficient of restitution" (or "COR"). The maximum COR for golf club heads is currently limited by the USGA at 0.83. Generally, a club head will have an area of highest response relative to other areas of the face, such as having the highest COR, which imparts the greatest energy and velocity to the ball, and this area is typically positioned at the center of the face. In one example, the area of highest response may have a COR that is equal to the prevailing USGA limit (e.g. 0.83), which may change over time. However, as described above, less energy is transferred during impacts outside this area. Accordingly, a need exists to customize or adjust the size and/or the location of the area of highest response of a golf club face to provide maximum energy transfer in the areas of the face where off-center hits tend to occur most.

The present device and method are provided to address the problems discussed above and other problems, and to provide advantages and aspects not provided by prior ball striking devices of this type. A full discussion of the features and advantages of the present invention is deferred to the following detailed description, which proceeds with reference to the accompanying drawings.

BRIEF SUMMARY

The following presents a general summary of aspects of the invention in order to provide a basic understanding of the invention. This summary is not an extensive overview of the invention. It is not intended to identify key or critical elements of the invention or to delineate the scope of the invention. The following summary merely presents some concepts of the invention in a general form as a prelude to the more detailed description provided below.

Aspects of the invention relate to ball striking devices, such as golf clubs, with a head that includes a face configured for striking a ball and a body connected to the face, the body being adapted for connection of a shaft thereto. Various example structures of heads described herein include one or more channels located proximate one or more edges of the face. The head has a region of highest COR response that is directionally enlarged toward each of the channels, as a result of the increased flexibility that the channels provide to the face. The channels can be positioned to change the size and/or shape of the region of highest response, based on locations on the face where a golfer tends to hit the ball, or other locations where it is advantageous to provide greater response and energy transfer during impact. Consequently, the golf shot may experience increased "kick" off the face and straighter ball flight on off-center hits (provided the off-center hits impact the face at the locations of increased response and at a sufficient velocity), e.g., due to increased flexibility of the face at these impact locations.

According to one aspect, the face includes a plurality of channels formed as one or more pairs of channels positioned proximate to each other. In one embodiment, the region of highest response is directionally enlarged toward an approximate midpoint between the channels of each pair.

According to another aspect, one or more channels may extend inwardly from the edges of the face in directions transverse or substantially transverse to the respective edges. In another embodiment, one or more channels may additionally or alternately extend generally parallel to the respective edges.

According to another aspect, one or more channels extend to the edges of the face, and also extend beyond the edges of the face and into the body. In another embodiment, one or more channels may extend proximate the edges of the face, and stop short of the edges.

According to another aspect, one or more of the channels are completely or partially filled with a flexible material. The flexible material generally has a flexibility that is greater than the material of the face, and may be a flexible polymer or composite or other flexible material.

According to a further aspect, one or more channels are formed as recesses in the outer surface of the face. In another embodiment, one or more channels are formed as slits completely through the face.

According to a further aspect, the club is a wood-type club head having four channels in the face. A first channel extends inward from a toe edge of the face, a second channel extends inward from a top edge of the face proximate the toe edge, a third channel extends inward from a lateral edge of the face and a fourth channel extends inward from a bottom edge of the face. The region of highest response is directionally enlarged toward the high-toe area and the low-heel area of the face.

According to a still further aspect, the club is an iron-type club head having two channels in the face. Both channels extend inward from the bottom edge of the face. The region of highest response is directionally enlarged toward the bottom edge of the face.

Other aspects of this invention relate to face members for use in a ball striking device, including a face, a wall extending rearward from an outer periphery of the face, and at least one channel in the outer surface of the face, extending inwardly from an outer edge of the face in a direction transverse or substantially transverse to the outer edge. The outer surface of the face is configured for striking a ball, and an inner surface is located rearward and opposite of the outer surface.

Further aspects of the invention relate to methods that can be used for manufacturing or customizing a golf club head, which is provided with a face configured for striking a ball with an outer surface thereof and a body connected to the face. The method includes forming at least one channel in the face, and may also include attaching a shaft to the head.

Still further aspects of the invention relate to golf clubs that include a golf club head as described above and a shaft connected to the head.

Other features and advantages of the invention will be apparent from the following description taken in conjunction with the attached drawings.

BRIEF DESCRIPTION OF THE DRAWINGS

To allow for a more full understanding of the present invention, it will now be described by way of example, with reference to the accompanying drawings in which:

FIG. 25 is a front view of an eighth illustrative embodiment of a head of an iron-type ball striking device according to the present invention;

FIG. 26 is a cross-sectional view of the head of FIG. 18, taken along lines 26-26 of FIG. 18;

DETAILED DESCRIPTION

Figure 1:
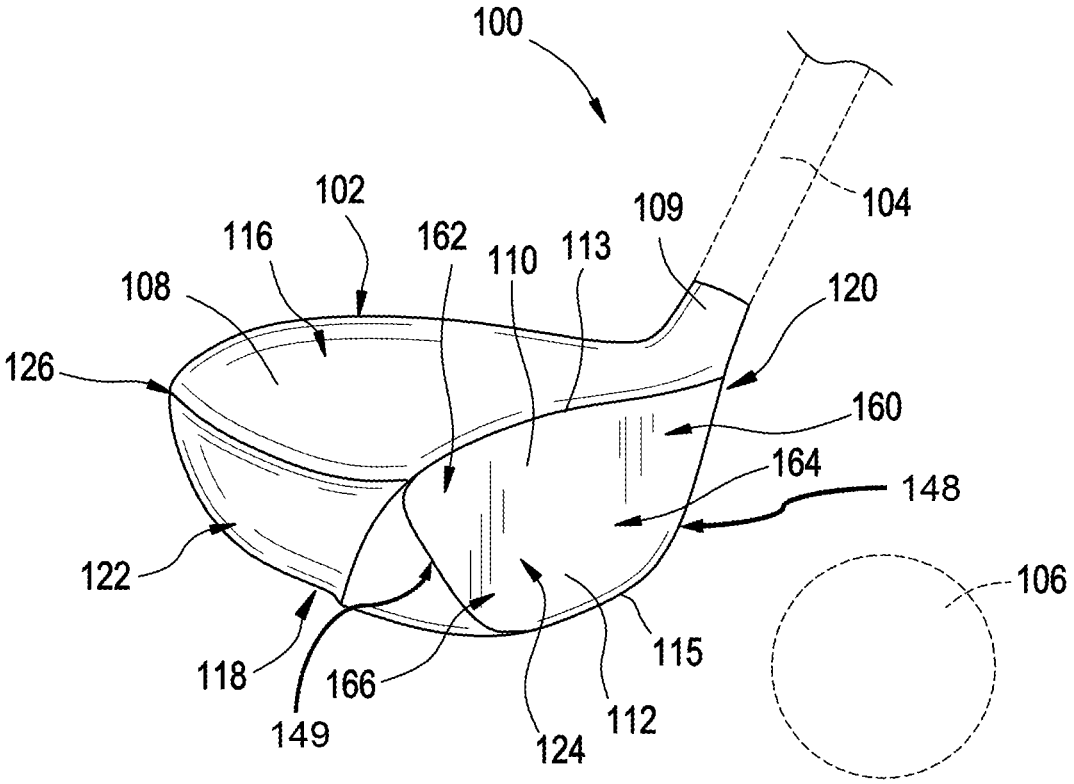
FIG. 1 is a perspective view of a head of a wood-type ball striking device that can be used in connection with aspects of the present invention, shown with a ball.

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," "rear," and the like may be used in this specification to describe various example features and elements of the invention, these terms are used herein as a matter of convenience, e.g., based on the example orientations shown in the figures or the orientation during typical use. Additionally, the term "plurality," as used herein, indicates any number greater than one, either disjunctively or conjunctively, as necessary, up to an infinite number. Nothing in this specification should be construed as requiring a specific three dimensional orientation of structures in order to fall within the scope of this invention. Also, the reader is advised that the attached drawings are not necessarily drawn to scale.

The following terms are used in this specification, and unless otherwise noted or clear from the context, these terms have the meanings provided below.

"Ball striking device" means any device constructed and designed to strike a ball or other similar objects (such as a hockey puck). In addition to generically encompassing "ball striking heads," which are described in more detail below, examples of "ball striking devices" include, but are not limited to: golf clubs, putters, croquet mallets, polo mallets, baseball or softball bats, cricket bats, tennis rackets, badminton rackets, field hockey sticks, ice hockey sticks, and the like.

"Ball striking head" means the portion of a "ball striking device" that includes and is located immediately adjacent (optionally surrounding) the portion of the ball striking device designed to contact the ball (or other object) in use. In some examples, such as many golf clubs and putters, the ball striking head may be a separate and independent entity from any shaft or handle member, and it may be attached to the shaft or handle in some manner.

The terms "shaft" and "handle" are used synonymously and interchangeably in this specification, and they include the portion of a ball striking device (if any) that the user holds during a swing of a ball striking device.

"Integral joining technique" means a technique for joining two pieces so that the two pieces effectively become a single, integral piece, including, but not limited to, irreversible joining techniques, such as adhesively joining, cementing, welding, brazing, soldering, or the like, where separation of the joined pieces cannot be accomplished without structural damage thereto.

"Virtual intersection point" means a point at which a first line, plane, edge, surface, etc. would intersect another line, plane, edge, surface, etc., if the first line, plane, edge, surface, etc. extended infinitely along a linear axis. A line, as referred to herein, includes a linear direction or axis, such as a direction or axis of extension or elongation.

"Generally parallel" means that a first line, plane, edge, surface, etc. is approximately (in this instance, within 5%) equidistant from another line, plane, edge, surface, etc., over at least 50% of the length of the first line, plane, edge, surface, etc.

"Transverse" means extending across or in a cross direction to a line, plane, edge, surface, etc., defined at an actual or virtual intersection point, but does not necessarily imply a perpendicular intersection.

"Substantially transverse" means that a line or plane is oriented such that the line or plane forms a minimum angle of 30° at an actual or virtual intersection point.

In general, aspects of this invention relate to ball striking devices, such as golf club heads, golf clubs, putter heads, putters, and the like. Such ball striking devices, according to at least some examples of the invention, may include a ball striking head and a ball striking surface. In the case of a golf club, the ball striking surface is a substantially flat surface on one face of the ball striking head. Some more specific aspects of this invention relate to wood-type golf clubs and golf club heads, including drivers, fairway woods, wood-type hybrid clubs, and the like, and some aspects of this invention may additionally or alternately be practiced with irons, iron-type hybrid clubs, and the like.

According to various aspects of this invention, the ball striking device may be formed of one or more of a variety of materials, such as metals (including metal alloys), ceramics, polymers, composites (including fiber-reinforced composites), and wood, and may be formed in one of a variety of configurations, without departing from the scope of the invention. In one illustrative embodiment, some or all components of the head, including the face and at least a portion of the body of the head, are made of metal. It is understood that the head may contain components made of several different materials, including carbon-fiber and other components. Additionally, the components may be formed by various forming methods. For example, metal components (such as titanium, aluminum, titanium alloys, aluminum alloys, steels (including stainless steels), and the like) may be formed by forging, molding, casting, stamping, machining, and/or other known techniques. In another example, composite components, such as carbon fiber-polymer composites, can be manufactured by a variety of composite processing techniques, such as prepreg processing, powder-based techniques, mold infiltration, and/or other known techniques.

The various figures in this application illustrate examples of ball striking devices according to this invention. When the same reference number appears in more than one drawing, that reference number is used consistently in this specification and the drawings refer to the same or similar parts throughout.

At least some examples of ball striking devices according to this invention relate to golf club head structures, including heads for wood-type golf clubs, such as drivers, as well as long iron clubs (e.g., driving irons, zero irons through five irons, and hybrid type golf clubs), short iron clubs (e.g., six irons through pitching wedges, as well as sand wedges, lob wedges, gap wedges, and/or other wedges), and putters. Such devices may include a one-piece construction or a multiple-piece construction. Example structures of ball striking devices according to this invention will be described in detail below in conjunction with FIG. 1, which illustrates an example of a ball striking device 100 in the form of a golf driver or other wood-type club, and FIG. 17, which illustrates an example of a ball striking device 200 in the form of an iron-type golf club, in accordance with at least some examples of this invention.

FIG. 1 illustrates a ball striking device 100 in the form of a golf driver, in accordance with at least some examples of this invention, and illustrative embodiments of heads 102 of ball striking devices 100 of this type are shown in FIGS. 2-16A. As shown in FIG. 1, the ball striking device 100 includes a ball striking head 102 and a shaft 104 connected to the ball striking head 102 and extending therefrom. A ball 106 in use is also schematically shown in FIG. 1, in a position to be struck by the ball striking device 100. The ball striking head 102 of the ball striking device 100 of FIG. 1 has a face 112 connected to a body 108, with a hosel 109 extending therefrom. Any desired hosel and/or head/shaft interconnection structure may be used without departing from this invention, including conventional hosel and/or head/shaft interconnection structures as are known and used in the art. For reference, the head 102 generally has a top 116, a bottom or sole 118, a heel 120 proximate the hosel 109, a toe 122 distal from the hosel 109, a front 124, and a back or rear 126. The shape and design of the head 102 may be partially dictated by the intended use of the device 100. In the club 100 shown in FIG. 1, the head 102 has a relatively large volume, as the club 100 is designed for use as a driver or wood-type club, intended to hit the ball accurately over long distances. In other applications, such as for a different type of golf club, the head may be designed to have different dimensions and configurations. When configured as a driver, the club head may have a volume of at least 400 cc, and in some structures, at least 450 cc, or even at least 460 cc. Other appropriate sizes for other club heads may be readily determined by those skilled in the art.

In the illustrative embodiment illustrated in FIG. 1, the head 102 has a hollow structure defining an inner cavity (e.g., defined by the face 112 and the body 108). Thus, the head 102 has a plurality of inner surfaces defined therein. In one embodiment, the hollow center cavity may be filled with air. However, in other embodiments, the head 102 could be filled with another material, such as foam. In still further embodiments, the solid materials of the head may occupy a greater proportion of the volume, and the head may have a smaller cavity or no inner cavity at all. It is understood that the inner cavity may not be completely enclosed in some embodiments.

Figure 11:
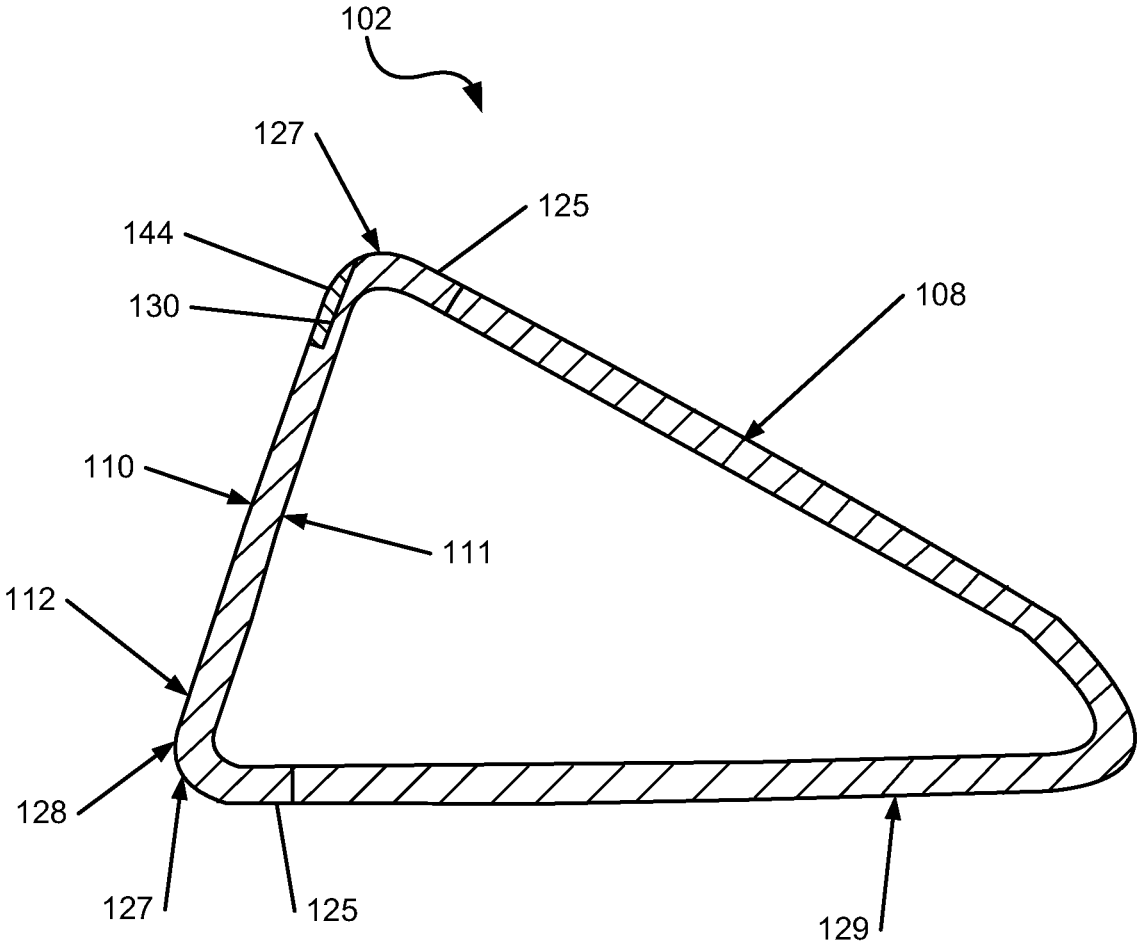
FIG. 11 is a cross-sectional view of the head of FIG. 2, taken along lines 11-11 of FIG. 2.

The face 112 is located at the front 124 of the head 102, and has a ball striking surface 110 located thereon and an inner surface 111 opposite the ball striking surface 110, as illustrated in FIGS. 1 and 11. The ball striking surface 110 is typically an outer surface of the face 112 configured to face a ball 106 in use, and is adapted to strike the ball 106 when the device 100 is set in motion, such as by swinging. As shown, the ball striking surface 110 is relatively flat, occupying most of the face 112. The face 112 has a plurality of outer edges 127, including a top edge 113, a bottom edge 115, and lateral edges (including heel edge 148 and toe edge 149). The edges 127 of the face may be defined as the boundaries of an area of the face 112 that is specifically designed to contact the ball 106 in use, and may be recognized as the boundaries of an area of the face 112 that is intentionally flattened and smoothed to be suited for ball contact. For reference purposes, the portion of the face 112 nearest the top face edge 113 and the heel 120 of the head 102 is referred to as the "high-heel area" 160; the portion of the face 112 nearest the top face edge 113 and toe 122 of the head 102 is referred to as the "high-toe area" 162; the portion of the face 112 nearest the bottom face edge 115 and heel 120 of the head 102 is referred to as the "low-heel area" 164; and the portion of the face 112 nearest the bottom face edge 115 and toe 122 of the head 102 is referred to as the "low-toe area" 166. Conceptually, these areas 160-166 may be recognized and referred to as quadrants of substantially equal size (and/or quadrants extending from a geometric center of the face 112), though not necessarily with symmetrical dimensions. The face 112 may include some curvature in the top to bottom and/or heel to toe directions (e.g., bulge and roll characteristics), as is known and is conventional in the art. In other embodiments, the surface 110 may occupy a different proportion of the face 112, or the body 108 may have multiple ball striking surfaces 110 thereon. In the illustrative embodiment shown in FIG. 1, the ball striking surface 110 is inclined slightly (i.e., at a loft angle), to give the ball 106 slight lift and spin when struck. In other illustrative embodiments, the ball striking surface 110 may have a different incline or loft angle, to affect the trajectory of the ball 106. Additionally, the face 112 may have a variable thickness and/or may have one or more internal or external inserts in some embodiments.

It is understood that the face 112, the body 108, and/or the hosel 109 can be formed as a single piece or as separate pieces that are joined together. The face 112 may be formed as part of a face frame member 128, with a wall or walls 125 extending rearward from the edges 127 of the face 112, as shown in the illustrative embodiments in FIGS. 11-16A. This configuration is also known as a cup face structure. The body 108 can be formed as a separate piece or pieces joined to the walls 125 of the face frame member 128. Additionally, the body 108 may be partially formed by a backbody member 129, which may be a single piece or multiple pieces, as also shown in the illustrative embodiments in FIGS. 11-16A. The walls 125 of the face frame member 128 combine with the backbody member 129 to form the body 108 of the head 102. These pieces may be connected by an integral joining technique, such as welding, cementing, or adhesively joining. Other known techniques for joining these parts can be used as well, including many mechanical joining techniques, including releasable mechanical engagement techniques. If desired, the hosel 109 may be integrally formed as part of the face frame member 128. Further, a gasket (not shown) may be included between the face frame member 128 and the backbody member 129.

Figure 17:
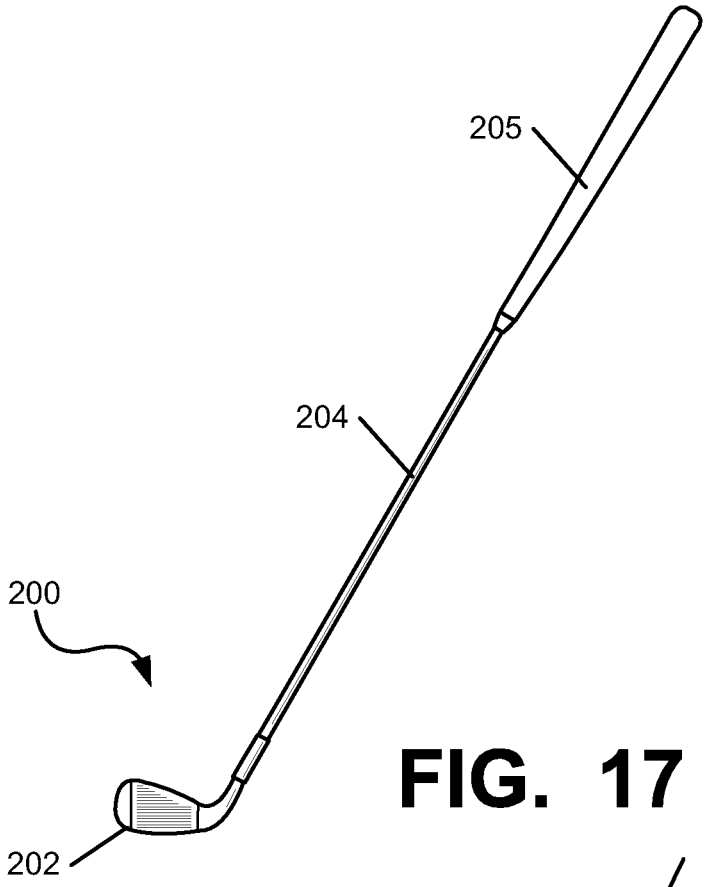
FIG. 17 is a perspective view of an iron-type ball striking device that can be used in connection with aspects of the present invention.

FIG. 17 illustrates a ball striking device 200 in the form of a golf iron, in accordance with at least some examples of this invention, and illustrative embodiments of heads 202 of ball striking devices 200 of this type are shown in FIGS. 18-28. Many common components between the ball striking device 100 of FIG. 1 and the ball striking device 200 of FIG. 17 are referred to using similar reference numerals in the description that follows, using the "200" series of reference numerals. The ball striking device 200 includes a shaft 204 and a golf club head 202 attached to the shaft 204. The golf club head 202 of FIG. 17 may be representative of any iron or hybrid type golf club head in accordance with examples of the present invention.

As shown in FIGS. 18-28, the golf club head 202 includes a body member 208 having a face 212 and a hosel 209 extending from the body 208 for attachment of the shaft 204. For reference, the head 202 generally has a top 216, a bottom or sole 218, a heel 220 proximate the hosel 209, a toe 222 distal from the hosel 209, a front 224, and a back or rear 226. The shape and design of the head 202 may be partially dictated by the intended use of the device 200. The heel portion 220 is attached to and/or extends from a hosel 209 (e.g., as a unitary or integral one piece construction, as separate connected elements, etc.).

The face 212 is located at the front 224 of the head 202, and has a ball striking surface 210 located thereon and an inner surface 211 opposite the ball striking surface 210. The ball striking surface 210 is typically an outer surface of the face 212 configured to face a ball (not shown) in use, and is adapted to strike the ball when the device 200 is set in motion, such as by swinging. As shown, the ball striking surface 210 is relatively flat, occupying most of the face 212. The ball striking surface 210 may include grooves 252 (e.g., generally horizontal grooves 252 extending across the face 212 in the illustrated example) for the removal of water and grass from the face 212 during a ball strike. Of course, any number of grooves, desired groove patterns, and/or groove constructions may be provided (or even no groove pattern, if desired), including conventional groove patterns and/or constructions, without departing from this invention.

For reference purposes, the portion of the face 212 nearest the top face edge 213 and the heel 220 of the head 202 is referred to as the "high-heel area" 260; the portion of the face 212 nearest the top face edge 213 and toe 222 of the head 202 is referred to as the "high-toe area" 262; the portion of the face 212 nearest the bottom face edge 215 and heel 220 of the head 202 is referred to as the "low-heel area" 264; and the portion of the face 212 nearest the bottom face edge 215 and toe 222 of the head 202 is referred to as the "low-toe area" 266. Conceptually, these areas 260-266 may be recognized and referred to as quadrants of substantially equal size (and/or quadrants extending from a geometric center of the face 212), though not necessarily with symmetrical dimensions. The face 212 may include some curvature in the top to bottom and/or heel to toe directions (e.g., bulge and roll characteristics), as is known and is conventional in the art. In other embodiments, the surface 210 may occupy a different proportion of the face 212, or the body 208 may have multiple ball striking surfaces 210 thereon. As seen in the illustrative embodiment shown in FIG. 24, the ball striking surface 210 is inclined (i.e., at a loft angle), to give the ball an appreciable degree of lift and spin when struck. In other illustrative embodiments, the ball striking surface 210 may have a different incline or loft angle, to affect the trajectory of the ball. Additionally, the face 212 may have a variable thickness and/or may have one or more internal or external inserts in some embodiments. It is understood that the face 212, the body 208, and/or the hosel 209 can be formed as a single piece or as separate pieces that are joined together.

The body member 208 of the golf club head 202 may be constructed from a wide variety of different materials, including materials conventionally known and used in the art, such as steel, titanium, aluminum, tungsten, graphite, polymers, or composites, or combinations thereof. Also, if desired, the club head 202 may be made from any number of pieces (e.g., having a separate face plate, etc.) and/or by any construction technique, including, for example, casting, forging, welding, and/or other methods known and used in the art.

The ball striking device 100, 200 may include a shaft 104, 204 connected to or otherwise engaged with the ball striking head 102, 202, as shown schematically in FIGS. 1 and 17. The shaft 104, 204 is adapted to be gripped by a user to swing the ball striking device 100, 200 to strike the ball 106. The shaft 104, 204 can be formed as a separate piece connected to the head 102, 202, such as by connecting to the hosel 109, 209, as shown in FIGS. 1 and 17. In other illustrative embodiments, at least a portion of the shaft 104, 204 may be an integral piece with the head 102, 202, and/or the head 102, 202 may not contain a hosel 109, 209 or may contain an internal hosel structure. Still further embodiments are contemplated without departing from the scope of the invention. The shaft 104, 204 may be constructed from one or more of a variety of materials, including metals, ceramics, polymers, composites, or wood. In some illustrative embodiments, the shaft 104, 204, or at least portions thereof, may be constructed of a metal, such as stainless steel or titanium, or a composite, such as a carbon/graphite fiber-polymer composite. However, it is contemplated that the shaft 104, 204 may be constructed of different materials without departing from the scope of the invention, including conventional materials that are known and used in the art. A grip element 205 may be positioned on the shaft 104, 204 to provide a golfer with a slip resistant surface with which to grasp golf club shaft 104, 204, as shown in FIG. 17. The grip element 205 may be attached to the shaft 104, 204 in any desired manner, including in conventional manners known and used in the art (e.g., via adhesives or cements, threads or other mechanical connectors, swedging/swaging, etc.).

In general, the head 102, 202 of the ball striking device 100, 200 has a face 112, 212 that contains at least one channel 130 thereon. In one embodiment, the face 112, 212 includes a plurality of channels 130, and the channels 130 are located proximate one or more edges 127, 227 of the face 112, 212. One or more of the channels 130 may be located "most proximate" to one edge 127, 227 of the face 112, 212, meaning relative to the other edges 127, 227 of the face 112, 212. Additionally, one or more of the channels 130 may have one end more proximal to a center of the face 112, 212 and an opposite end distal from the center of the face 112, 212 and more proximal to an outer edge 127, 227 of the face 112, 212. FIGS. 2-10 illustrate different embodiments of wood-type ball striking devices 100A-J, each including a head 102 that has a plurality of channels 130 located proximate one or more outer edges 127, 227 of the face 112. FIGS. 18-25 illustrate different embodiments of iron-type ball striking devices 200A-F, each including a head 202 that has a plurality of channels 130 located proximate one or more outer edges 127, 227 of the face 112, 212. These various embodiments are described in greater detail below. It is explicitly understood that the definition of "channels," as used in describing the various embodiments of channels 130 herein, does not encompass traditional face grooves, such as the face grooves 252 illustrated in FIGS. 18-25 or the face grooves 152 shown in FIGS. 2-10. The structure and function of such traditional face grooves 152, 252, as well as other features, differ from those of the channels 130 described herein. Additionally, the channels 130 are generally not located in the typical hitting zone or high-COR zone of the face 112, 212, while face grooves 252 may be located in the center of the face 112, 212. In one embodiment, no portion of any of the channels 130 extends to within an approximately 1.5 inch distance from the geometric center of the face 112, 212.

In the embodiments shown in FIGS. 2-10 and 18-25, each face 112, 212 has a region or area of highest response 140 located proximate the center of the face 112, 212. The "response" of the face 112, 212 generally refers to the ability of the face 112, 212 (or region thereof) to transfer energy in an impact with a ball, and may be expressed as the coefficient of restitution (COR) as described above. In these embodiments, the region of highest response 140 is directionally enlarged substantially toward each channel 130. Generally, the channels 130 increase the flexibility of the face 112, 212, and as a result, the region of highest response 140 becomes directionally enlarged toward the channels 130. In one embodiment, the center of the face 112, 212 has high COR response due to a trampoline-like effect that results upon impact with a ball, and the increased flexibility imparted by the channels 130 changes the shape of the region of the face 112, 212 that experiences the greatest degree of trampoline effect. As used herein, "directionally enlarged" means that the region of highest response 140 is enlarged, distorted, or otherwise extended in a general direction, as compared to the region of highest response in an otherwise identical face that contains no channels 130 as defined herein. In one embodiment, directional enlargement may be measured by a deviation from an approximately circular area located at an approximate center of the face 112, 212. It is understood that this approximately circular area may be slightly elliptical in shape, as shown, for example, in FIGS. 18-25. The approximate direction(s) of directional enlargement are indicated in each embodiment by arrows 142, and the approximate enlargement of the region of highest response 140 relative to an approximately circular area at the center of the face 112, 212 is illustrated schematically by lighter and darker shaded areas. The approximately circular area is intended to represent the region of highest response in an otherwise identical face that contains no channels 130 as defined herein. The "center" of the face 112, 212 referred to herein may be a geometric center of the face 112, 212 and/or a center of gravity of the face 112, 212. The geometric center and the center of gravity have approximately the same location in the embodiments of FIGS. 2-10 and 18-25. In some embodiments, as described below, the region 140 may be directionally enlarged 142 toward a point located between two or more adjacent channels 130, such as an approximate midpoint between the adjacent channels 130. It is understood that the region of highest response 140 may also have a higher flexibility and lower stiffness relative to other areas of the face 112, 212, and may be referred to accordingly.

Figure 2:
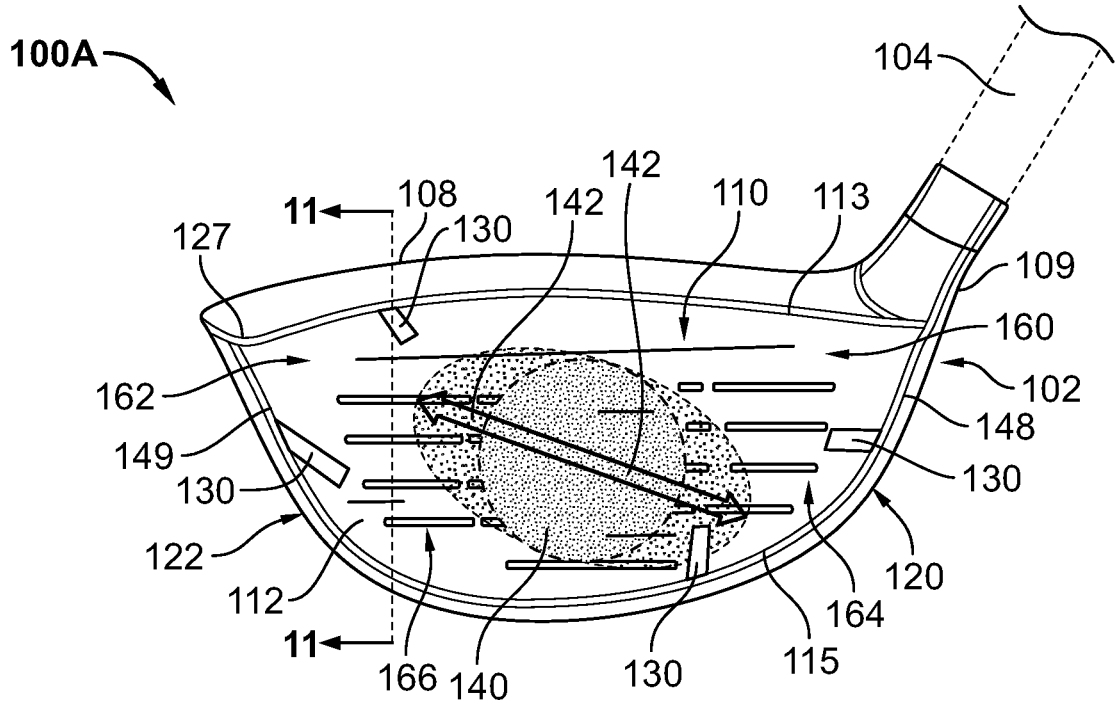
FIG. 2 is a front view of an illustrative embodiment of a head of a wood-type ball striking device according to the present invention.

FIG. 2 illustrates an embodiment of a ball striking device 100A with a wood-type head 102 that includes four elongated channels 130 located proximate the outer edges 127 of the face 112. Each channel 130 is located most proximate to one of the three remaining channels 130, relative to the other two of the remaining channels 130, and these most proximate channels 130 may be conceptually referred to as "pairs" of channels 130. One pair of channels 130 is located in the high-toe area 162 of the face 112, and the other pair of channels 130 is located in the low-heel area 164 of the face 112. Each of the channels 130 contacts the outer edge 127 of the face 112, and extends inwardly from the respective outer edge 127 of the face 112, in a direction transverse or substantially transverse to the respective edge 127. For the channels 130 in the high-toe area 162, one channel 130 extends inward from a toe edge 149 of the face 112 and the other channel 130 extends inward from the top edge 113 of the face most proximate the toe edge 149. For the channels 130 in the low-heel area 164, one channel 130 extends inward from a heel edge 148 of the face 112 and the other channel 130 extends inward from the bottom edge 115 of the face 112 most proximate the heel edge 148. Additionally, as indicated by the arrow 142 in FIG. 2, the region of highest response 140 is directionally enlarged toward the channels 130. More specifically, in this embodiment, the region of highest response 140 is enlarged in a direction generally toward the midpoints between each of the pairs of channels 130, toward the high-toe area 162 and the low-heel area 164 of the face 112.

Figure 12:
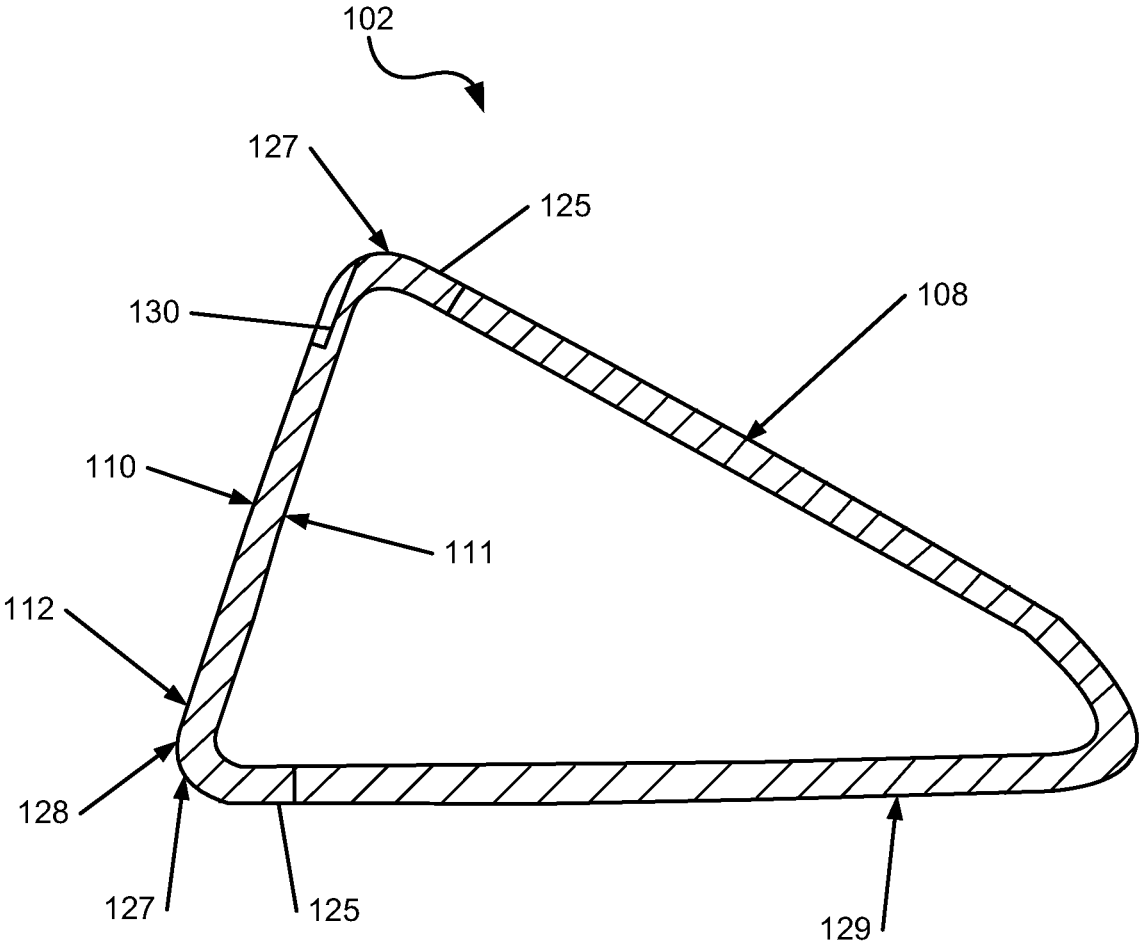
FIG. 12 is a cross-sectional view of an alternate embodiment of the head of FIG. 2, shown along lines 11-11 of FIG. 2.
Figure 13:
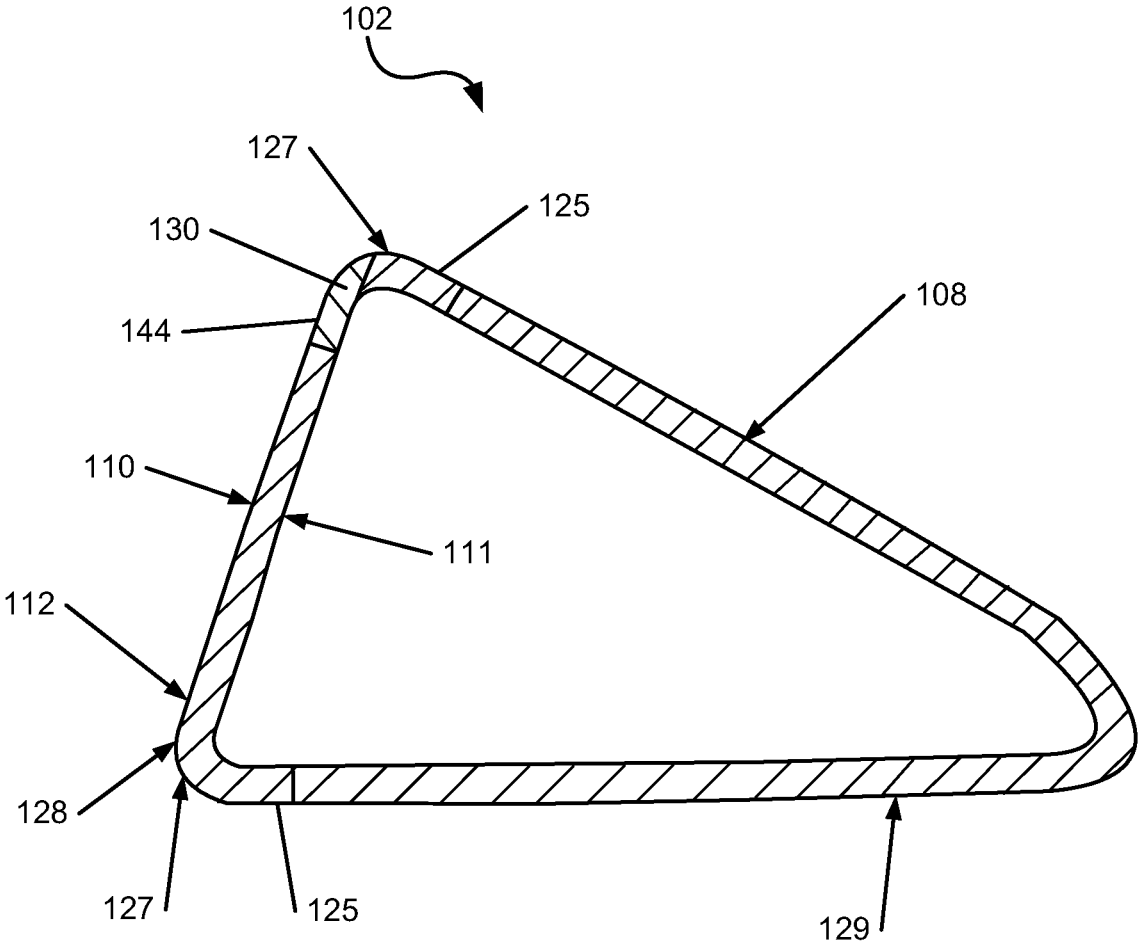
FIG. 13 is a cross-sectional view of a second alternate embodiment of the head of FIG. 2, shown along lines 11-11 of FIG. 2.
Figure 14:
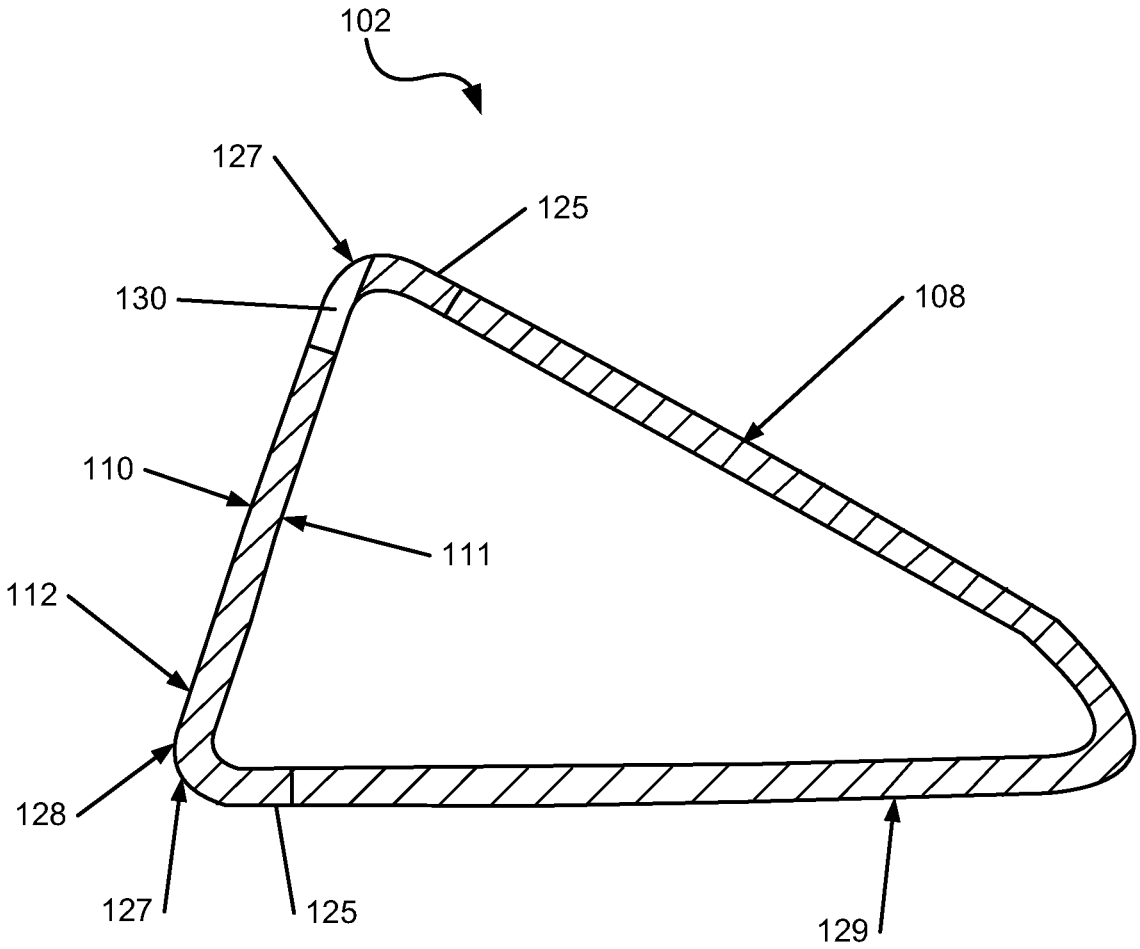
FIG. 14 is a cross-sectional view of a third alternate embodiment of the head of FIG. 2, shown along lines 11-11 of FIG. 2.

In the embodiment shown in FIG. 2, the channels 130 are formed as recesses that extend through a portion of the thickness of the face 112, as shown in FIG. 11. Additionally, the channels 130 are each filled with a flexible material 144 that has a flexibility greater than the flexibility of the material of the face 112. For example, the flexible material 144 may be rubber or another polymeric material, or may alternately be a relatively flexible metal, ceramic, composite, etc. In one embodiment, the flexibility of the flexible material 144 may be at least two times greater than the flexibility of the material of the face 112. The flexibilities of the materials can be quantified by using the modulus of each material or another quantitative measurement of flexibility. It is understood that the channels 130 may be partially or completely filled with the flexible material 144, in various embodiments. In another embodiment, as shown in FIG. 12, the channels 130 may be formed as recesses in the face 112 and may not be filled with the flexible material 144. In other embodiments, as shown in FIGS. 13-14, the channels 130 may be formed as slits extending completely through the face 112. In the embodiment shown in FIG. 13, the channels 130 extend completely through the face 112 and are filled with a flexible material 144, and in the embodiment shown in FIG. 14, the channels 130 are not filled with the flexible material 144. It is understood that in some embodiments, one or more of the channels 130 may be filled and one or more other channels 130 may not be filled, and that different channels 130 may be filled with different materials 144. Additionally, the channels 130 shown in FIGS. 11-14 have a generally consistent depth, but it is understood that one or more of the channels 130 may have a varying depth. Further, it is understood that one or more channels 130 may have consistent depth, but that only a portion of the channel(s) 130 may extend through the face 112, due to contours and/or thickness variations of the face 112. Still further, only one channel 130 is illustrated in FIGS. 11-14, and the other channels 130 may have the same configuration or a different configuration as the channel 130 illustrated, and multiple channels 130 in the same face 112 may have different configurations.

Additionally, at least some of the channels 130 may be arranged in pairs that are oriented at oblique angles to one another and the region of highest response 140 is directionally enlarged toward the channels 130 of each pair. As shown, for example, in FIG. 2, the channels 130 extend inwardly from adjacent outer edges 127 of the face 112, and are oriented at angles of less than or equal to 90° at their virtual intersection point. Conceptually, the channels 130 in the high-toe area 162 of the face 112 in FIG. 2 may be referred to as one pair, and the channels 130 in the low-heel area 164 of the face 112 may be referred to as another pair. Further examples of this configuration can be seen in FIGS. 3-6, and 9-10, as well as FIGS. 23-25, described in greater detail below. As another example, at least some of the pairs of channels 130 may be arranged at oblique angles of greater than 90°, as shown, for example, in FIGS. 5 and 22, described in greater detail below. Still further, at least some of the channels 130 may be parallel or generally parallel to each other, such as shown in FIGS. 7-8 and 18-21, described in greater detail below. It is understood that these arrangements can be used in connection with any of the channel configurations shown in FIGS. 2-16A and 18-28, as well as other configurations.

Figure 3:
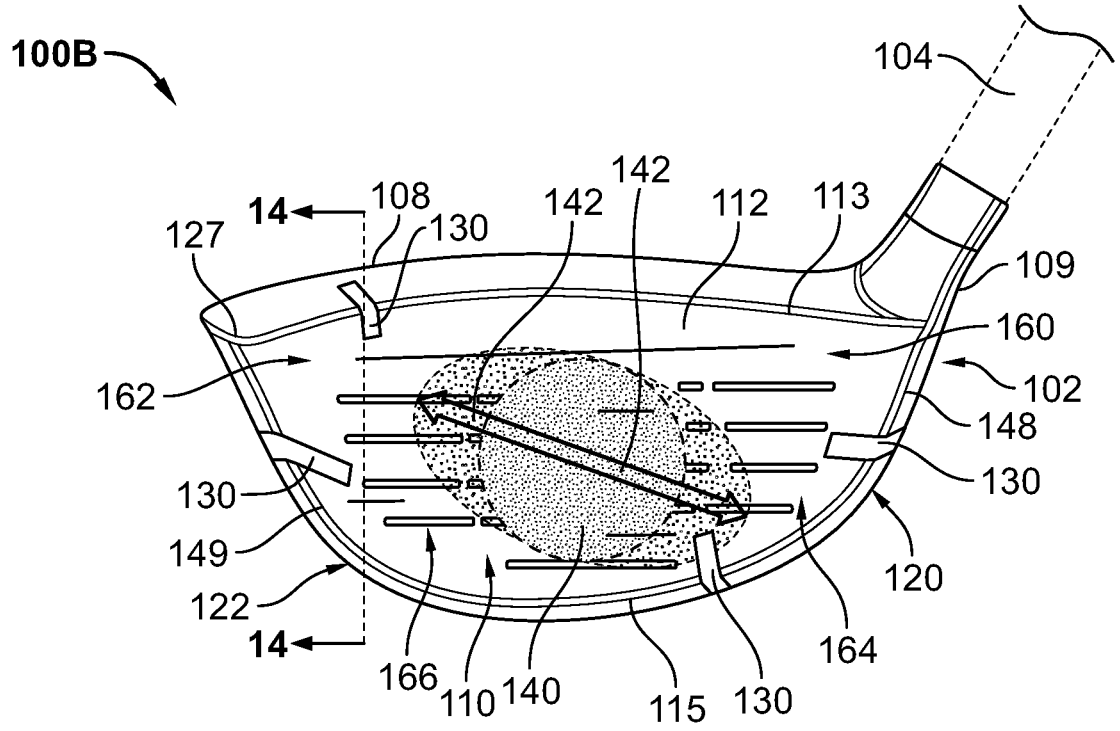
FIG. 3 is a front view of a second illustrative embodiment of a head of a wood-type ball striking device according to the present invention.

FIG. 3 illustrates an embodiment of a ball striking device 100B with a wood-type head 102 that includes two pairs of elongated channels 130 located proximate the outer edges 127 of the face 112, in a configuration similar to the configuration of the head 102 shown in FIG. 2. As in the embodiment in FIG. 2, one pair of channels 130 is located in the high-toe area 162 of the face 112, and the other pair of channels 130 is located in the low-heel area 164 of the face 112. Each of the channels 130 extends inwardly from an outer edge 127 of the face 112, in a direction transverse or substantially transverse to the respective edge 127. However, in the embodiment shown in FIG. 3, the channels 130 extend past the outer edges 127 of the face 112, and extend rearward through a portion of the body 108. Additionally, as indicated by the arrows 142 in FIG. 3, the region of highest response 140 is directionally enlarged toward the channels 130, similar to the embodiment shown in FIG. 2. More specifically, in this embodiment, the region of highest response 140 is enlarged in a direction generally toward the midpoints between each of the pairs of channels 130, toward the high-toe area 162 and the low-heel area 164 of the face 112.

Figure 14A:
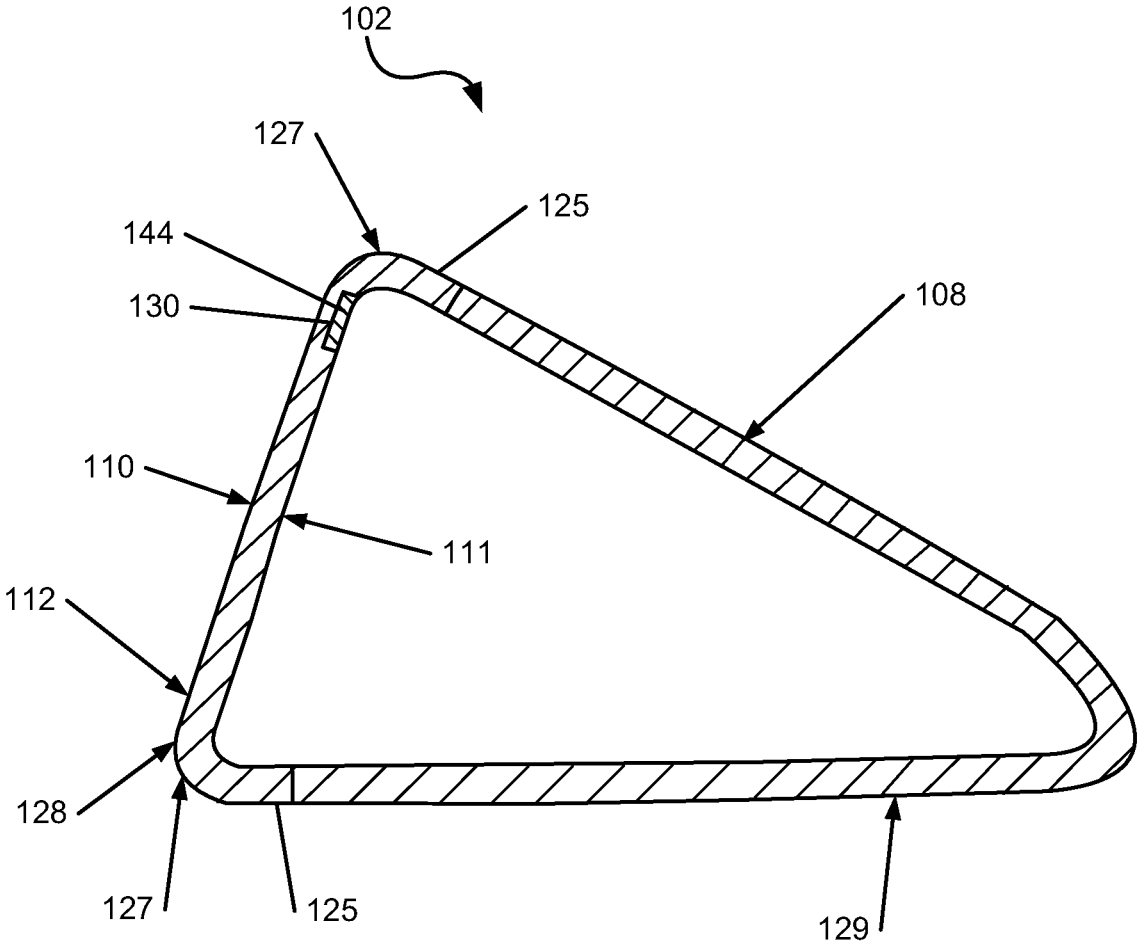
FIG. 14A is a cross-sectional view of a fourth alternate embodiment of the head of FIG. 2, shown along lines 11-11 of FIG. 2.
Figure 15:
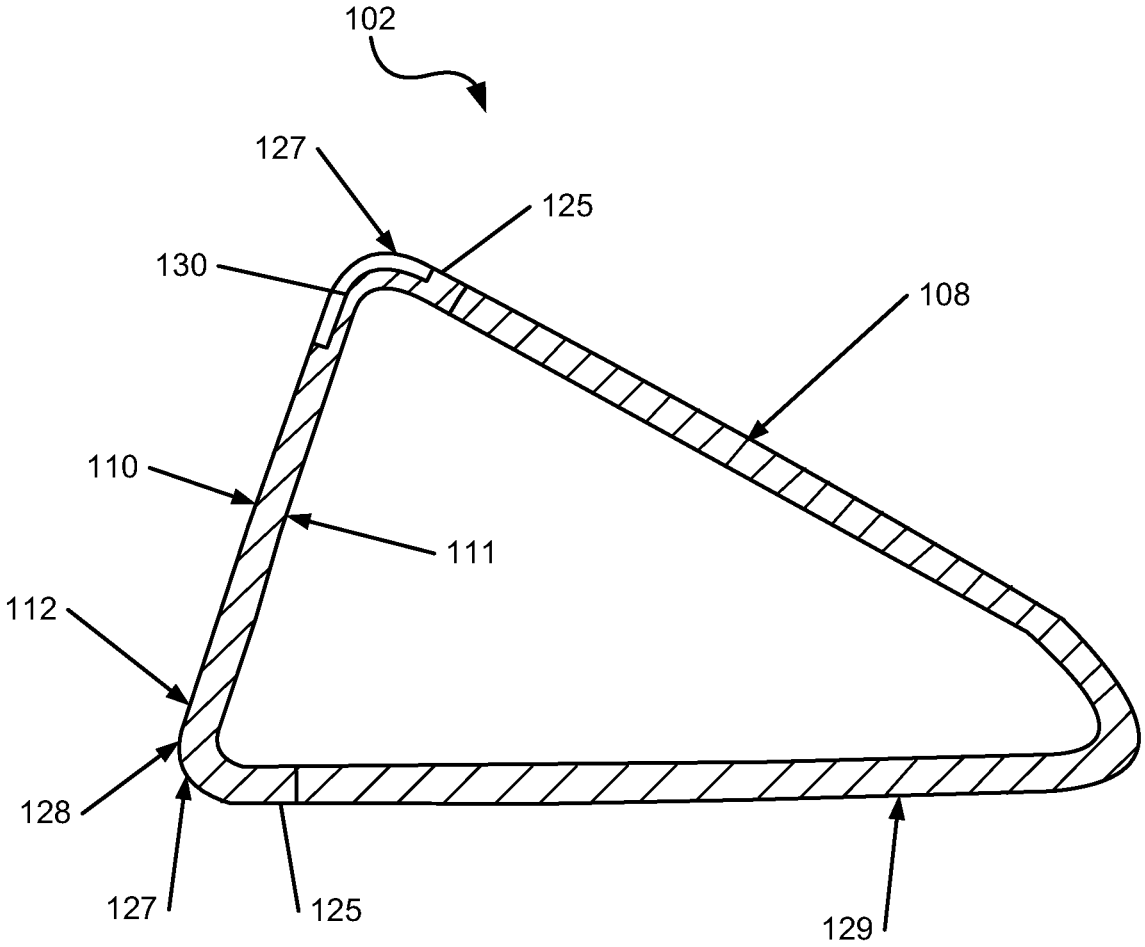
FIG. 15 is a cross-sectional view of the head of FIG. 3, taken along lines 15-15 of FIG. 3.
Figure 16:
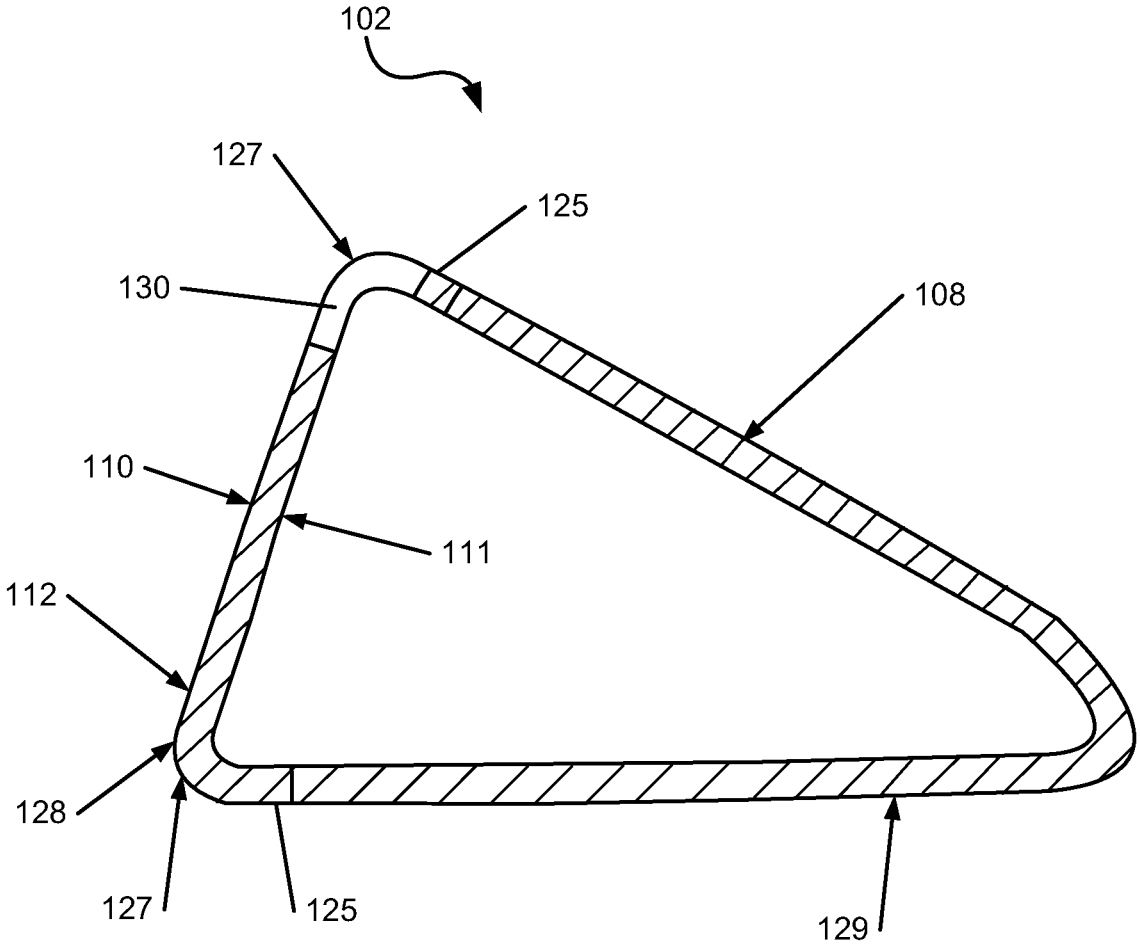
FIG. 16 is a cross-sectional view of an alternate embodiment of the head of FIG. 3, shown along lines 15-15 of FIG. 3.
Figure 16A:
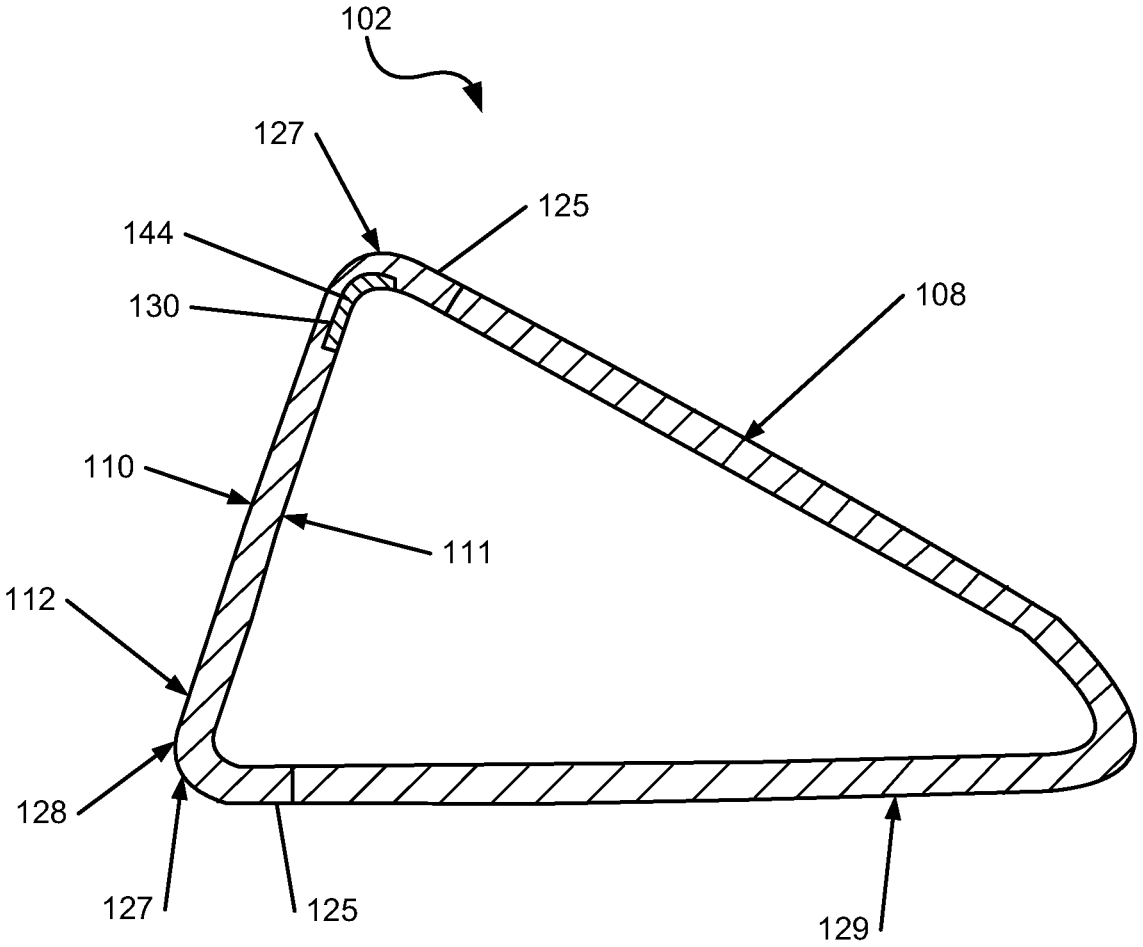
FIG. 16A is a cross-sectional view of a second alternate embodiment of the head of FIG. 3, shown along lines 15-15 of FIG. 3.

In the embodiment shown in FIG. 3, the channels 130 are formed as recesses that extend through a portion of the thickness of the face 112, as shown in FIG. 15. In another embodiment, as shown in FIG. 16, the channels 130 may be formed as slits extending completely through the face 112. In the embodiments shown in FIGS. 15-16, the channels 130 are not filled with any material. However, in other embodiments, the channels 130 may be partially or completely filled with a flexible material 144, as shown in FIGS. 11, 13, 14A, and 16A. In the embodiments shown in FIGS. 15-16A, where the head 102 contains a face frame member 128, the channels 130 may extend through a portion of the wall 125 of the face frame member 128. In another embodiment, the channels 130 may extend through the entire wall 125, and may extend into the backbody member 129. It is understood that in other embodiments, the head 102 may not contain a face frame member 128. As similarly described above with respect to FIGS. 11-14, it is understood that in some embodiments, one or more of the channels 130 may be filled and one or more other channels 130 may not be filled, and that different channels 130 may be filled with different materials 144. Additionally, the channels 130 shown in FIGS. 15-16A have a generally consistent depth, but it is understood that one or more of the channels 130 may have a varying depth. Further, it is understood that one or more channels 130 may have consistent depth, but that only a portion of the channel(s) 130 may extend through the face 112, due to contours and/or thickness variations of the face 112. Still further, only one channel 130 is illustrated in FIGS. 15-16A, and the other channels 130 may have the same configuration or a different configuration as the channel 130 illustrated, and multiple channels 130 in the same face 112 may have different configurations.

In another embodiment, the channels 130 may be recesses on the inner surface 111 of the face 112 that extend through a portion of the thickness of the face 112, such as shown in FIGS. 14A and 16A. In the embodiment shown in FIG. 14A, the channel 130 is a recess located on the inner surface 111 of the face 112 and extending through a portion of the thickness of the face 112. In the embodiment shown in FIG. 16A, the channel 130 is a recess located on the inner surface 111 of the face and extending through a portion of the thickness of the face 112, and also extending rearward into a portion of the wall 125 and the body 108. Additionally, in the embodiments shown in FIGS. 14A and 16A, the channels 130 have a flexible material 144 contained therein. However, it is understood that in another embodiment, the channels 130 may have no flexible material 144 therein, and may vary as described above with respect to FIGS. 11-14 and 15-16.

Figure 4:
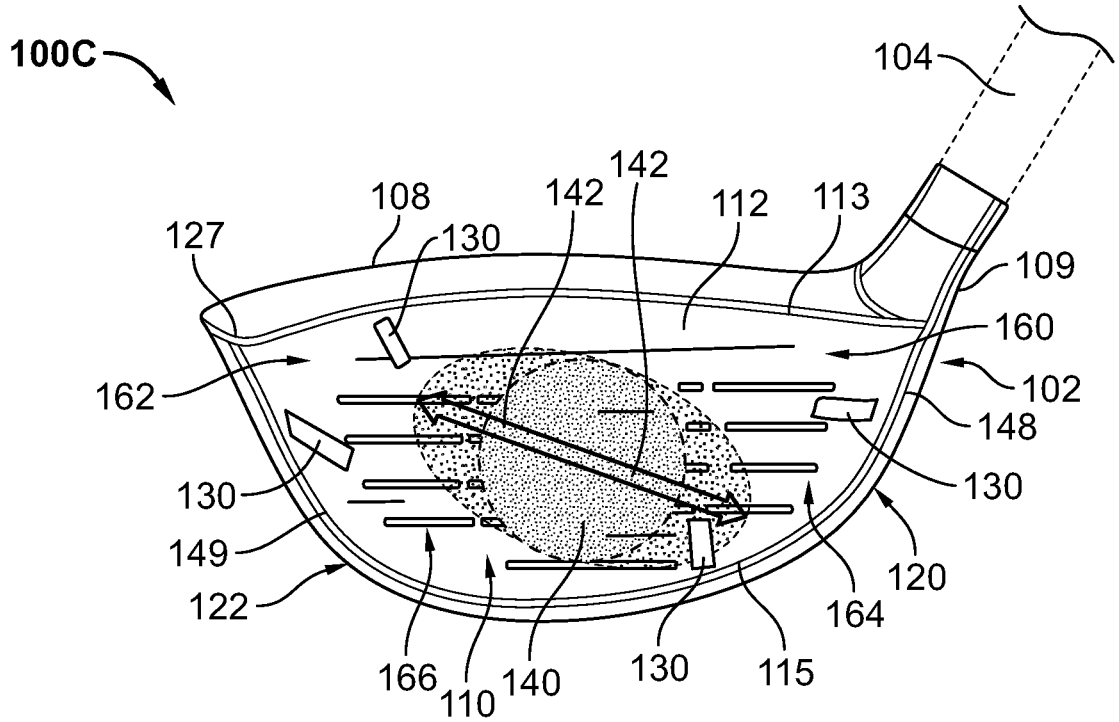
FIG. 4 is a front view of a third illustrative embodiment of a head of a wood-type ball striking device according to the present invention.

FIG. 4 illustrates an embodiment of a ball striking device 100C with a wood-type head 102 that includes two pairs of elongated channels 130 located proximate the outer edges 127 of the face 112, in a configuration similar to the configuration of the head 102 shown in FIG. 2. As in the embodiment in FIG. 2, one pair of channels 130 is located in the high-toe area 162 of the face 112, and the other pair of channels 130 is located in the low-heel area 164 of the face 112. Each of the channels 130 extends inwardly from points adjacent the outer edge 127 of the face 112, in a direction transverse or substantially transverse to the respective edge 127. However, in the embodiment shown in FIG. 4, the channels 130 do not extend to the outer edges 127 of the face 112; rather the channels 130 stop short of the outer edges 127. Additionally, as indicated by the arrows 142 in FIG. 4, the region of highest response 140 is directionally enlarged toward the channels 130, similar to the embodiment shown in FIG. 2. More specifically, in this embodiment, the region of highest response 140 is enlarged in a direction generally toward the midpoints between each of the pairs of channels 130, toward the high-toe area 162 and the low-heel area 164 of the face 112.

Figure 5:
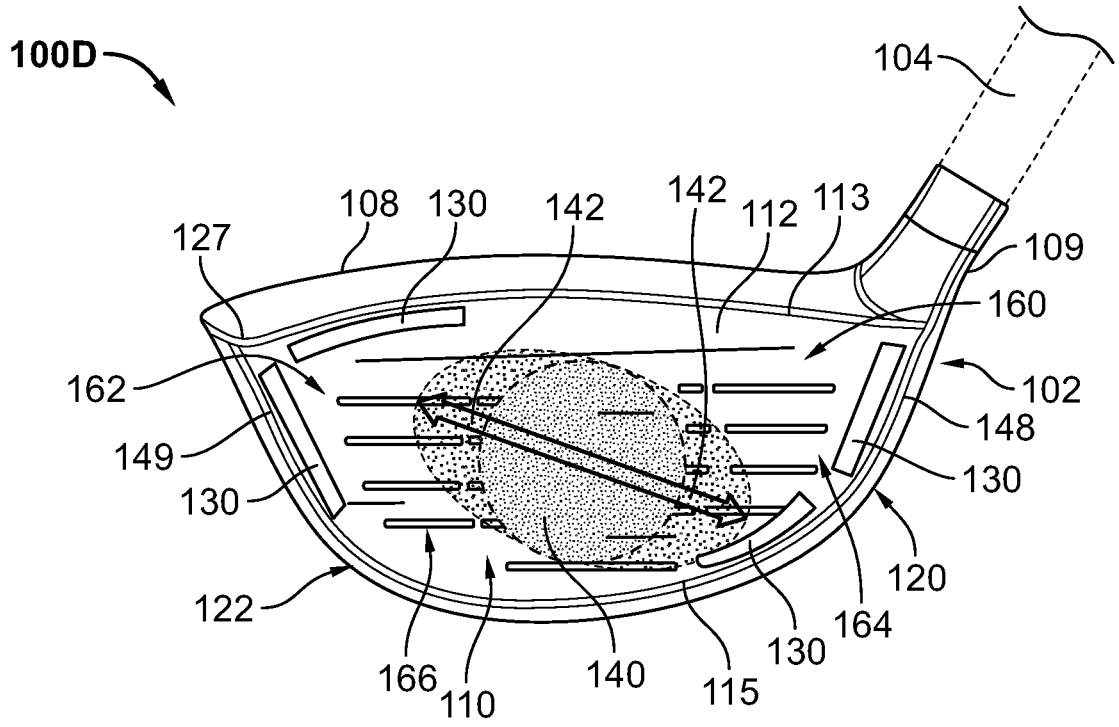
FIG. 5 is a front view of a fourth illustrative embodiment of a head of a wood-type ball striking device according to the present invention.

FIG. 5 illustrates an embodiment of a ball striking device 100D with a wood-type head 102 that includes two pairs of elongated channels 130 located proximate the outer edges 127 of the face 112. As in the embodiment in FIG. 2, one pair of channels 130 is located in the high-toe area 162 of the face 112, and the other pair of channels 130 is located in the low-heel area 164 of the face 112. However, in the embodiment of FIG. 5, each of the channels 130 extends generally parallel to an outer edge 127 of the face 112, adjacent to the respective edge 127. For the channels 130 in the high-toe area 162, one channel 130 extends generally parallel to the toe edge 149 of the face 112 and the other channel 130 extends generally parallel to the top edge 113 of the face 112 most proximate the toe edge 149. For the channels 130 in the low-heel area 164, one channel 130 extends generally parallel to the heel edge 148 of the face 112 and the other channel 130 extends generally parallel to the bottom edge 115 of the face 112 most proximate the heel edge 148. Additionally, two of the channels 130 in the embodiment shown in FIG. 5 are curvilinear, specifically, the uppermost and lowermost channels 130. Further, as indicated by the arrows 142 in FIG. 5, the region of highest response 140 is directionally enlarged toward the channels 130, similar to the embodiment shown in FIG. 2. More specifically, in this embodiment, the region of highest response 140 is enlarged in a direction generally toward the midpoints between each of the pairs of channels 130, toward the high-toe area 162 and the low-heel area 164 of the face 112.

Figure 6:
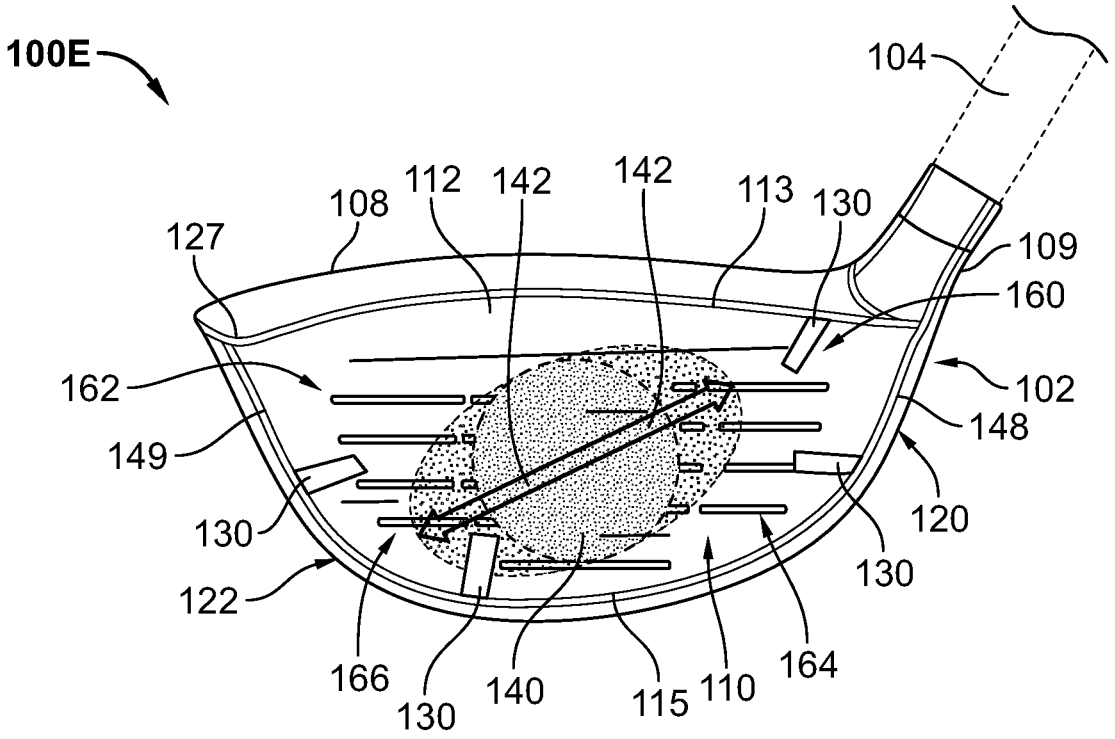
FIG. 6 is a front view of a fifth illustrative embodiment of a head of a wood-type ball striking device according to the present invention.

FIG. 6 illustrates an embodiment of a ball striking device 100E with a wood-type head 102 that includes two pairs of elongated channels 130 located proximate the outer edges 127 of the face 112. One pair of channels 130 is located in the high-heel area 160 of the face 112, and the other pair of channels 130 is located in the low-toe area 166 of the face 112. Each of the channels 130 extends inwardly from points adjacent the outer edge 127 of the face 112, in a direction transverse or substantially transverse to the respective edge 127, similarly to the channels 130 of the embodiment shown in FIG. 2. For the channels 130 in the high-heel area 160, one channel 130 extends inward from the heel edge 148 of the face 112 and the other channel 130 extends inward from the top edge 113 of the face most proximate the heel edge 148. For the channels 130 in the low-toe area 166, one channel 130 extends inward from the toe edge 149 of the face 112 and the other channel 130 extends inward from the bottom edge 115 of the face 112 most proximate the toe edge 149. Additionally, as indicated by the arrows 142 in FIG. 6, the region of highest response 140 is directionally enlarged toward the channels 130. More specifically, in this embodiment, the region of highest response 140 is enlarged in a direction generally toward the midpoints between each of the pairs of channels 130, toward the high-heel area 160 and the low-toe area 166 of the face 112.

Figure 7:
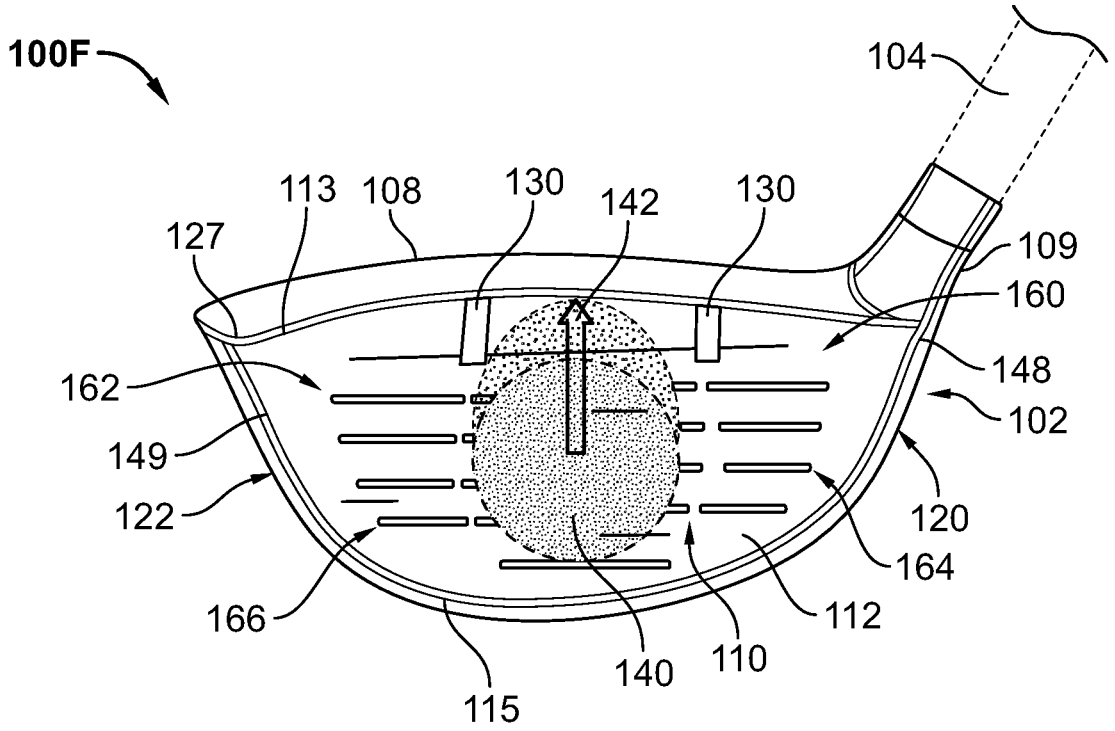
FIG. 7 is a front view of a sixth illustrative embodiment of a head of a wood-type ball striking device according to the present invention.

FIG. 7 illustrates an embodiment of a ball striking device 100F with a wood-type head 102 that includes one pair of elongated channels 130 located proximate the outer edge 127 of the face 112. The channels 130 are located most proximate the top face edge 113 and extend inwardly from the top edge 113 of the face 112, in a direction transverse or substantially transverse to the top face edge 113. Additionally, as indicated by the arrow 142 in FIG. 7, the region of highest response 140 is directionally enlarged toward the channels 130. More specifically, in this embodiment, the region of highest response 140 is enlarged in a direction generally toward the midpoint between the pair of channels 130, toward the top edge 113 of the face 112. Such a configuration may be useful, e.g., for a golfer who frequently hits a driver high on the face 112, which can occur when using a very long tee or as a product of a golfer's swing (e.g., for a golfer who drops his/her shoulder on the downswing).

Figure 8:
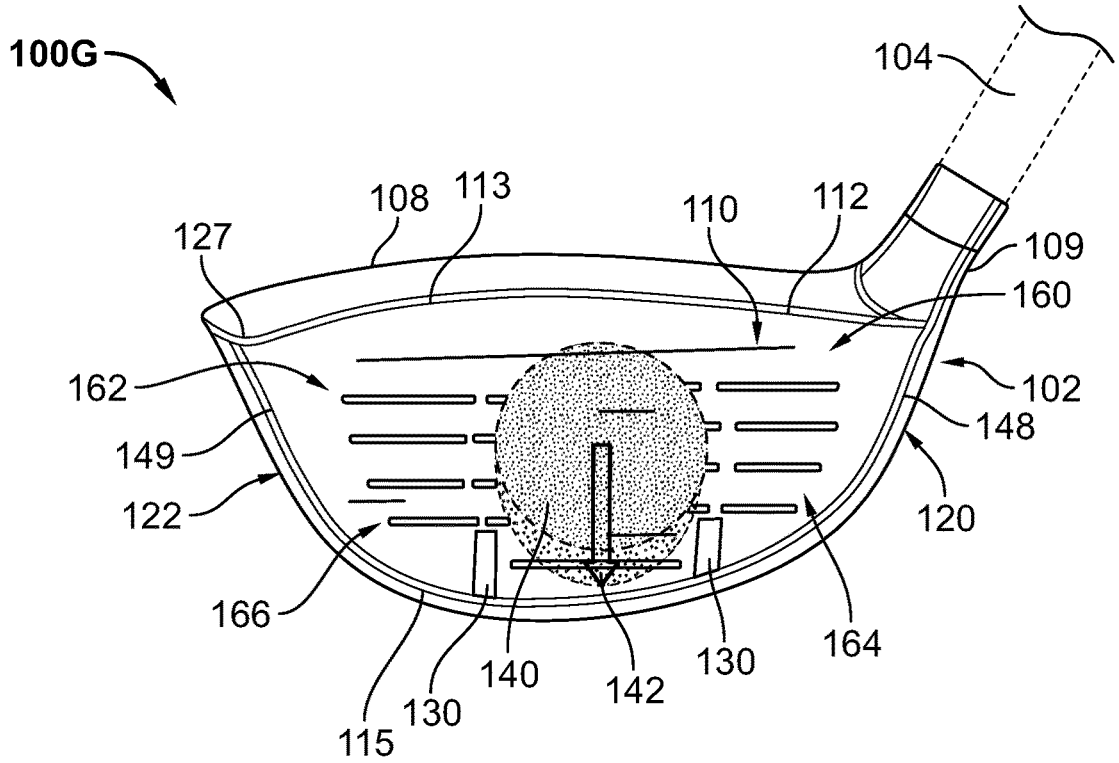
FIG. 8 is a front view of a seventh illustrative embodiment of a head of a wood-type ball striking device according to the present invention.

FIG. 8 illustrates an embodiment of a ball striking device 100G with a wood-type head 102 that includes one pair of elongated channels 130 located proximate the outer edge 127 of the face 112. The channels 130 are located most proximate the bottom face edge 115 and extend inwardly from the bottom edge 115 of the face 112, in a direction transverse or substantially transverse to the bottom face edge 115. Additionally, as indicated by the arrow 142 in FIG. 8, the region of highest response 140 is directionally enlarged toward the channels 130. More specifically, in this embodiment, the region of highest response 140 is enlarged in a direction generally toward the midpoint between the pair of channels 130, toward the bottom edge 115 of the face 112. Such a configuration may be useful, e.g., for a golfer who frequently hits a driver low on the face 112, which can occur when using a relatively short tee with a driver having a large face area or as a product of a golfer's swing (e.g., for a golfer who lifts his/her head up on the downswing).

Figure 9:
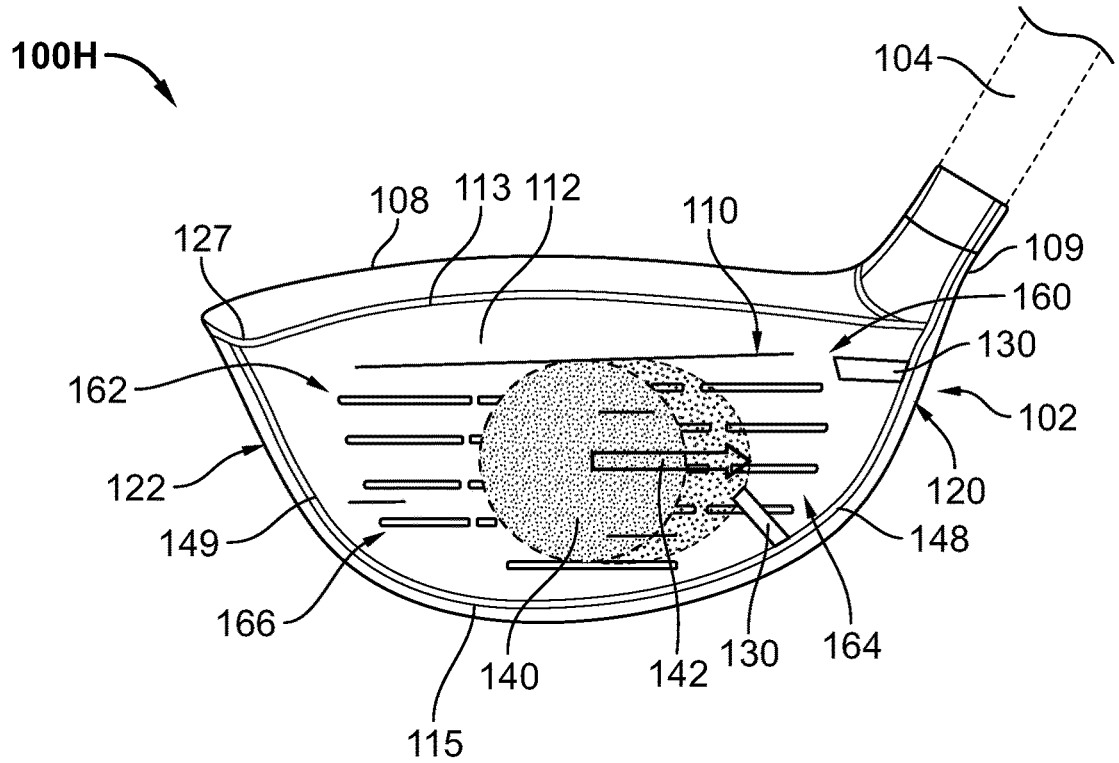
FIG. 9 is a front view of an eighth illustrative embodiment of a head of a wood-type ball striking device according to the present invention.

FIG. 9 illustrates an embodiment of a ball striking device 100H with a wood-type head 102 that includes one pair of elongated channels 130 located proximate the outer edge 127 of the face 112. The channels 130 are located most proximate the heel 120 and extend inwardly from the outer face edge 127 at the heel edge 148, in a direction transverse or substantially transverse to the edge 148. Additionally, as indicated by the arrow 142 in FIG. 9, the region of highest response 140 is directionally enlarged toward the channels 130. More specifically, in this embodiment, the region of highest response 140 is enlarged in a direction generally toward the midpoint between the pair of channels 130, toward the heel 120 of the face 112.

Figure 10:
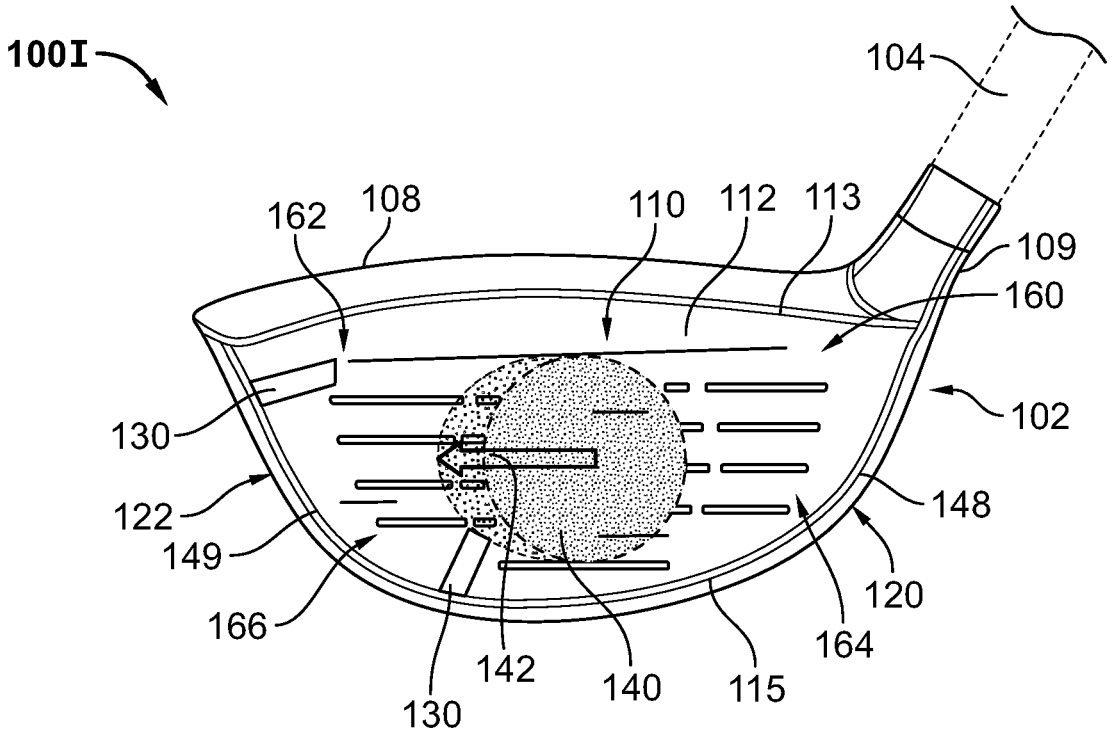
FIG. 10 is a front view of a ninth illustrative embodiment of a head of a wood-type ball striking device according to the present invention.

FIG. 10 illustrates an embodiment of a ball striking device 100I with a wood-type head 102 that includes one pair of elongated channels 130 located proximate the outer edge 127 of the face 112. The channels 130 are located most proximate the toe 122 and extend inwardly from the outer face edge 127 at the toe edge 149, in a direction transverse or substantially transverse to the edge 149. Additionally, as indicated by the arrow 142 in FIG. 9, the region of highest response 140 is directionally enlarged toward the channels 130. More specifically, in this embodiment, the region of highest response 140 is enlarged in a direction generally toward the midpoint between the pair of channels 130, toward the toe 122 of the face 112.

In the embodiments described above and shown in FIGS. 4-10, the channels 130 may extend partially or completely through the face 112, and may be empty or filled partially or completely with a flexible material 144, as described above with respect to FIGS. 11-16A. Additionally, the channels 130 in the embodiments described above and shown in FIGS. 4-10 may have any other configuration or variation described above with respect to FIGS. 2-3 and 11-16A.

Figure 18:
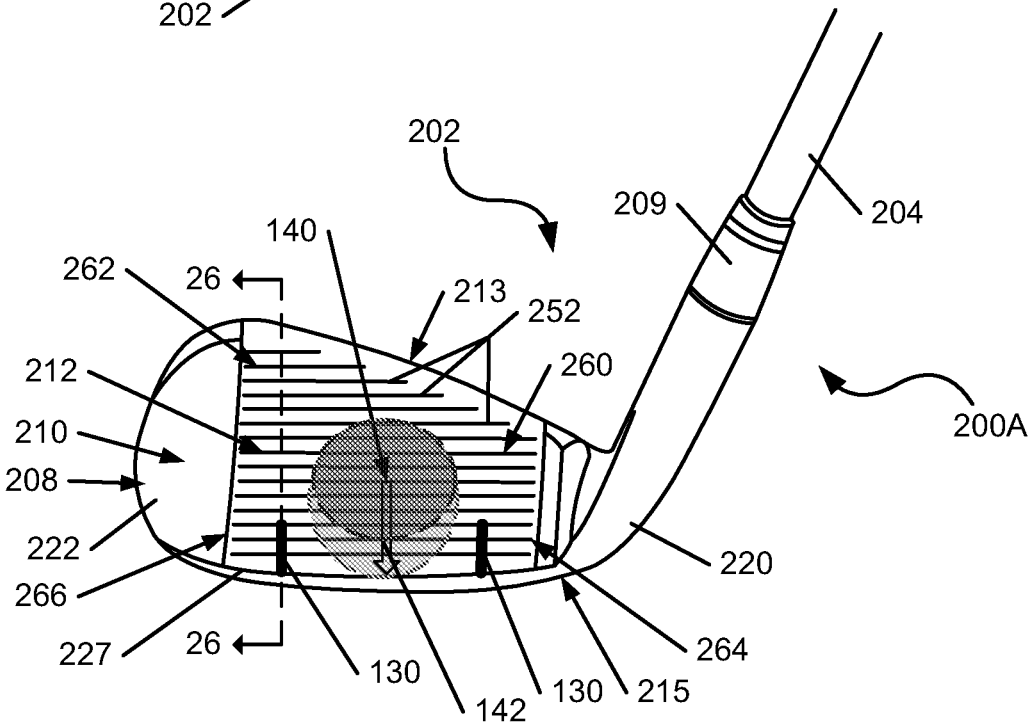
FIG. 18 is a front view of an illustrative embodiment of a head of an iron-type ball striking device according to the present invention.

FIG. 18 illustrates an embodiment of a ball striking device 200A with an iron-type head 202 that includes one pair of elongated channels 130 located proximate the outer edge 227 of the face 212. The channels 130 are located most proximate to the bottom face edge 215 and extend inwardly from the bottom edge 215 of the face 212, in a direction transverse or substantially transverse to the bottom face edge 215. Additionally, as indicated by the arrow 142 in FIG. 18, the region of highest response 140 is directionally enlarged toward the channels 130. More specifically, in this embodiment, the region of highest response 140 is enlarged in a direction generally toward the midpoint between the pair of channels 130, toward the bottom edge 215 of the face 212. In this embodiment, the channels 130 extend through a portion of the thickness of the face 212, and are at least partially filled with a flexible material 144, as shown in FIG. 26. In other embodiments, the channels 130 may have any configuration or variation described above with respect to FIGS. 2-3 and 11-16A. For example, as described above with respect to FIGS. 11-16A, one or more of the channels 130 may extend partially or completely through the face 212, and/or may be empty or filled partially or completely with a flexible material 144. As similarly described above, it is understood that in some embodiments, one or more of the channels 130 may be filled and one or more other channels 130 may not be filled, and that different channels 130 may be filled with different materials 144. As another example, the channel 130 shown in FIG. 26 has a generally consistent depth, but it is understood that one or more of the channels 130 may have a varying depth. As a further example, it is understood that one or more channels 130 may have consistent depth, but that only a portion of the channel(s) 130 may extend through the face 212, due to contours and/or thickness variations of the face 212. Still further, only one channel 130 is illustrated in FIG. 26, and the other channels 130 may have the same configuration or a different configuration as the channel 130 illustrated, and multiple channels 130 in the same face 212 may have different configurations.

Figure 19:
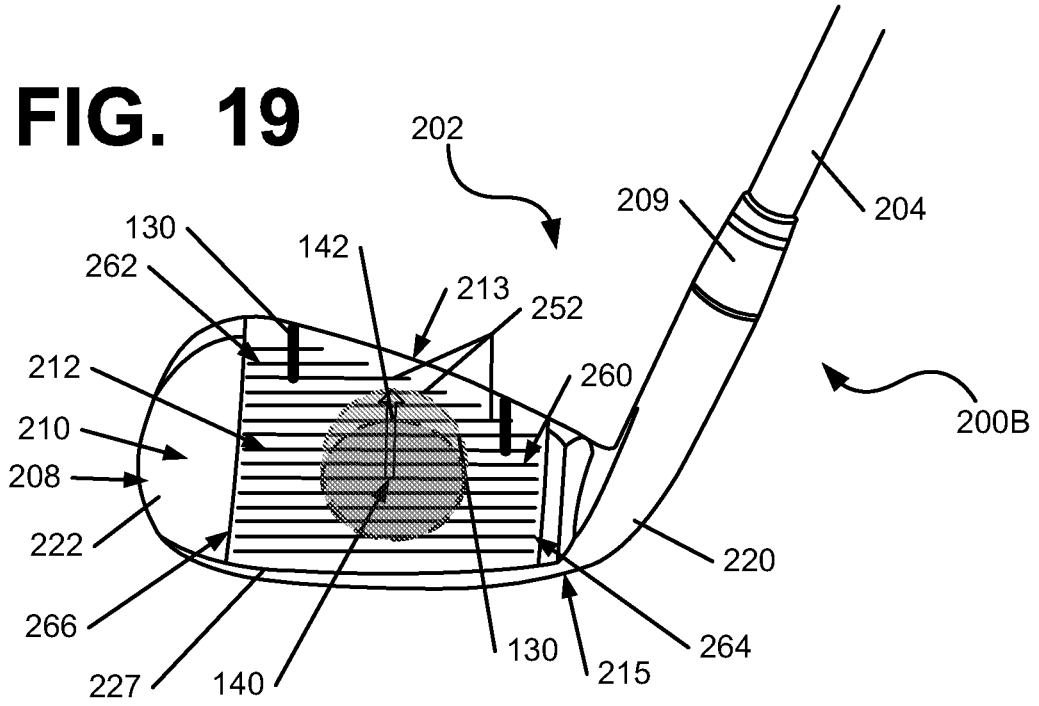
FIG. 19 is a front view of a second illustrative embodiment of a head of an iron-type ball striking device according to the present invention.

FIG. 19 illustrates an embodiment of a ball striking device 200B with an iron-type head 202 that includes one pair of elongated channels 130 located proximate the outer edge 227 of the face 212. The channels 130 are located most proximate the top face edge 213 and extend inwardly from the top edge 213 of the face 212, in a direction transverse or substantially transverse to the top face edge 213. Additionally, as indicated by the arrow 142 in FIG. 19, the region of highest response 140 is directionally enlarged toward the channels 130. More specifically, in this embodiment, the region of highest response 140 is enlarged in a direction generally toward the midpoint between the pair of channels 130, toward the top edge 213 of the face 212.

Figure 20:
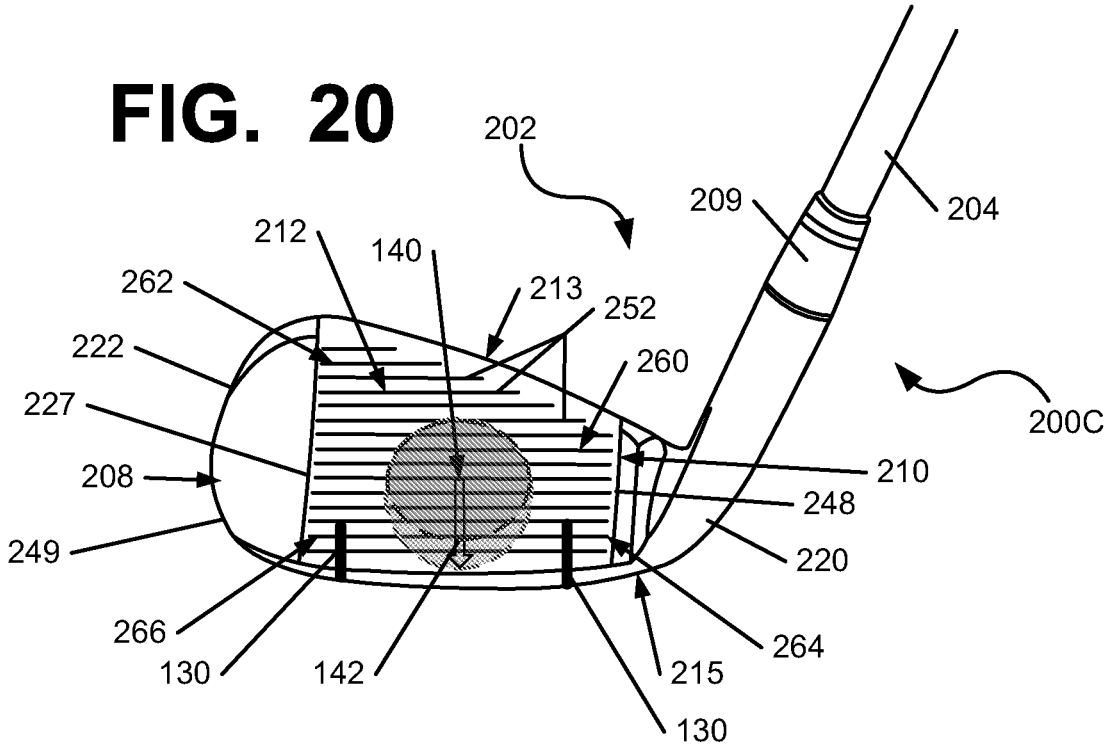
FIG. 20 is a front view of a third illustrative embodiment of a head of an iron-type ball striking device according to the present invention.

FIG. 20 illustrates an embodiment of a ball striking device 200C with an iron-type head 202 that includes one pair of elongated channels 130 located proximate the outer edge 227 of the face 212, in a configuration similar to the embodiment shown in FIG. 18. The channels 130 are located most proximate the bottom face edge 215 and extend inwardly from the bottom edge 215 of the face 212, in a direction transverse or substantially transverse to the bottom face edge 215. However, in the embodiment shown in FIG. 20, the channels 130 extend past the bottom edge 215 of the face 212, and extend rearward through a portion of the body 208. Additionally, as indicated by the arrow 142 in FIG. 20, the region of highest response 140 is directionally enlarged toward the channels 130. More specifically, in this embodiment, the region of highest response 140 is enlarged in a direction generally toward the midpoint between the pair of channels 130, toward the bottom edge 215 of the face 212.

Figure 21:
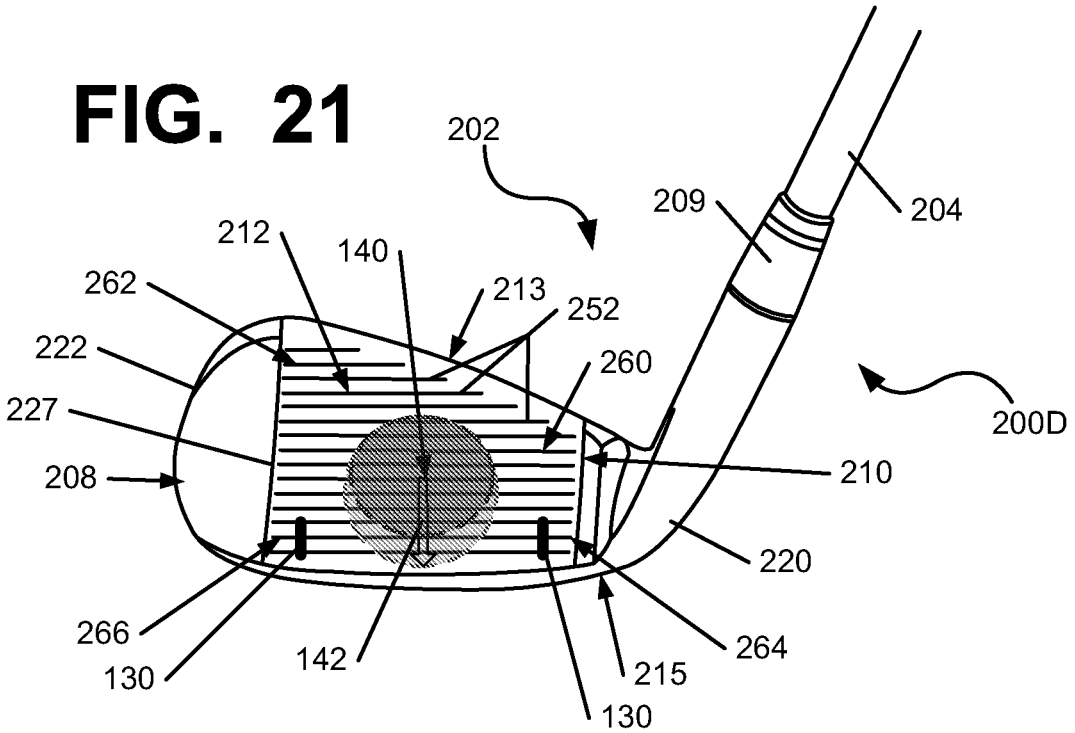
FIG. 21 is a front view of a fourth illustrative embodiment of a head of an iron-type ball striking device according to the present invention.

FIG. 21 illustrates an embodiment of a ball striking device 200D with an iron-type head 202 that includes one pair of elongated channels 130 located proximate the outer edge 227 of the face 212, in a configuration similar to the embodiment shown in FIG. 18. The channels 130 are located most proximate the bottom face edge 215 and extend inwardly from the bottom edge 215 of the face 212, in a direction transverse or substantially transverse to the bottom face edge 215. However, in the embodiment shown in FIG. 21, the channels 130 do not extend to the bottom edge 215 of the face 212; rather the channels 130 stop short of the bottom edge 215. Additionally, as indicated by the arrow 142 in FIG. 20, the region of highest response 140 is directionally enlarged toward the channels 130. More specifically, in this embodiment, the region of highest response 140 is enlarged in a direction generally toward the midpoint between the pair of channels 130, toward the bottom edge 215 of the face 212.

Figure 22:
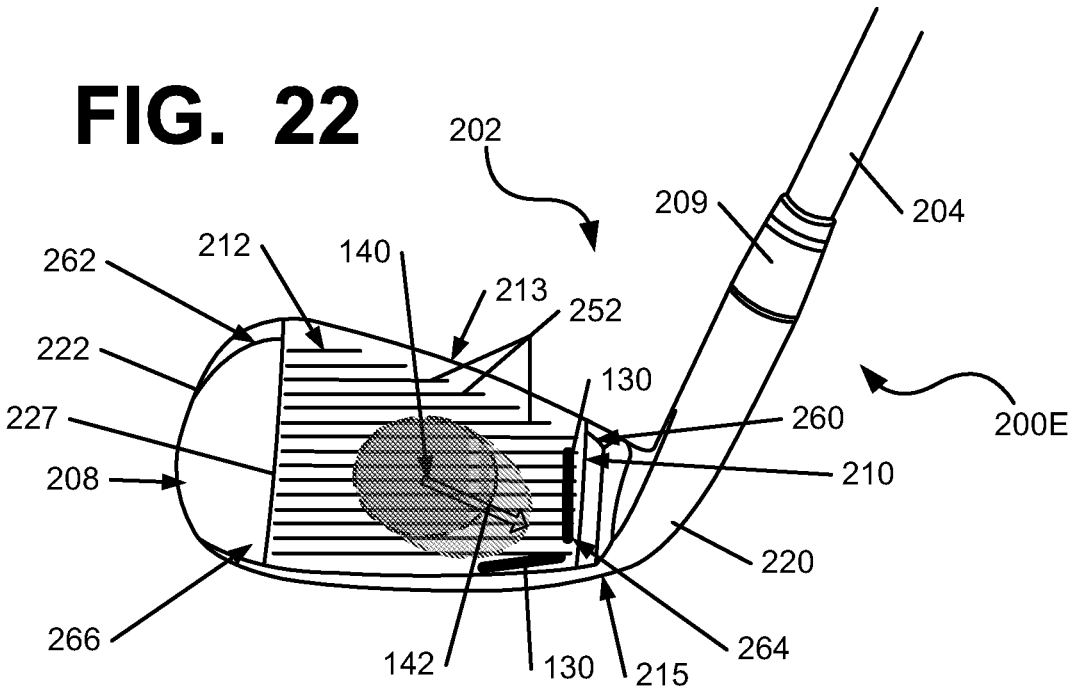
FIG. 22 is a front view of a fifth illustrative embodiment of a head of an iron-type ball striking device according to the present invention.

FIG. 22 illustrates an embodiment of a ball striking device 200E with an iron-type head 202 that includes one pair of elongated channels 130 located proximate the outer edge 227 of the face 212. The pair of channels 130 is located in the low-heel area 264 of the face 212. In the embodiment of FIG. 22, each of the channels 130 extends generally parallel to the most proximate outer edge 227 of the face 212, adjacent to the respective edge 227. Additionally, as indicated by the arrow 142 in FIG. 22, the region of highest response 140 is directionally enlarged toward the channels 130. More specifically, in this embodiment, the region of highest response 140 is enlarged in a direction generally toward the midpoint between the pair of channels 130, toward the low-heel area 264 of the face 212.

Figure 23:
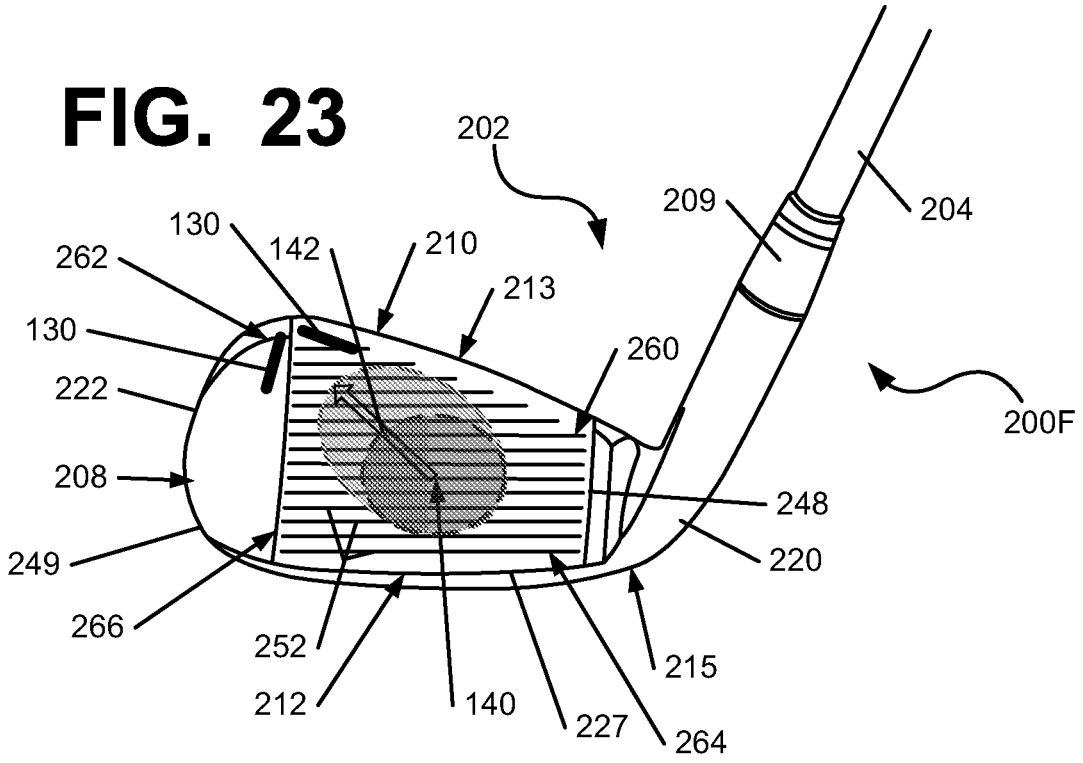
FIG. 23 is a front view of a sixth illustrative embodiment of a head of an iron-type ball striking device according to the present invention.

FIG. 23 illustrates an embodiment of a ball striking device 200F with an iron-type head 202 that includes one pair of elongated channels 130 located proximate the outer edge 227 of the face 212. The pair of channels 130 is located in the high-toe area 262 of the face 212. In the embodiment of FIG. 23, each of the channels 130 extends generally parallel to the most proximate outer edge 227 of the face 212, adjacent to the respective edge 227. Additionally, as indicated by the arrow 142 in FIG. 23, the region of highest response 140 is directionally enlarged toward the channels 130. More specifically, in this embodiment, the region of highest response 140 is enlarged in a direction generally toward the midpoint between the pair of channels 130, toward the high-toe area 262 of the face 212.

Figure 24:
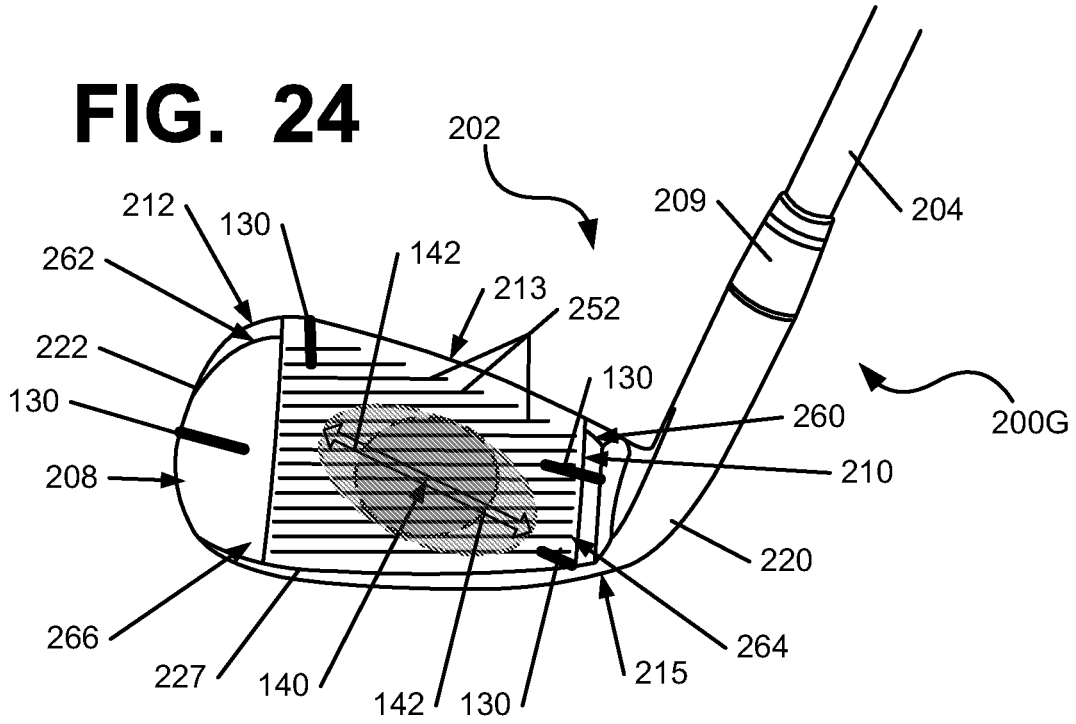
FIG. 24 is a front view of a seventh illustrative embodiment of a head of an iron-type ball striking device according to the present invention.

FIG. 24 illustrates an embodiment of a ball striking device 200G with an iron-type head 202 that includes two pairs of elongated channels 130 located proximate the outer edge 227 of the face 212. One pair of channels 130 is located in the high-toe area 262 of the face 212, and the other pair of channels 130 is located in the low-heel area 264 of the face 212. In the embodiment of FIG. 24, each of the channels 130 extends in a direction transverse or substantially transverse to the most proximate outer edge 227 of the face 212. Additionally, as indicated by the arrow 142 in FIG. 24, the region of highest response 140 is directionally enlarged toward the channels 130. More specifically, in this embodiment, the region of highest response 140 is enlarged in a direction generally toward the midpoints between each of the pairs of channels 130, toward the high-toe area 262 and the low-heel area 264 of the face 212.

FIG. 25 illustrates an embodiment of a ball striking device 200H with an iron-type head 202 that includes four elongated channels 130 located proximate the outer edge 227 of the face 212. One pair of channels 130 is located in the low-toe area 266 of the face 212, and another pair of channels 130 is located in the low-heel area 264 of the face 212. In the embodiment of FIG. 25, each of the channels 130 extends in a direction transverse or substantially transverse to the most proximate outer edge 227 of the face 212. Additionally, as indicated by the arrow 142 in FIG. 25, the region of highest response 140 is directionally enlarged toward the channels 130. More specifically, in this embodiment, the region of highest response 140 is enlarged in a direction generally toward the midpoints between the pairs of channels 130, toward the low-toe area 266 and the low-heel area of the face 212. Further, the channels 130 on the bottom edge 215 of the face 212 cause the region of highest response 140 to be enlarged toward the bottom edge 215 of the face 212, generally toward a midpoint between the channels 130, as also indicated by the arrows 142 in FIG. 25.

In the embodiments described above and shown in FIGS. 19-25, the channels 130 may extend partially or completely through the face 212, and may be empty or filled partially or completely with a flexible material 144, as described above with respect to FIGS. 11-16A and 26. Additionally, the channels 130 in the embodiments described above and shown in FIGS. 4-10 may have any other configuration or variation described above with respect to FIGS. 2-3 and 11-16A and 26.

Figure 27:
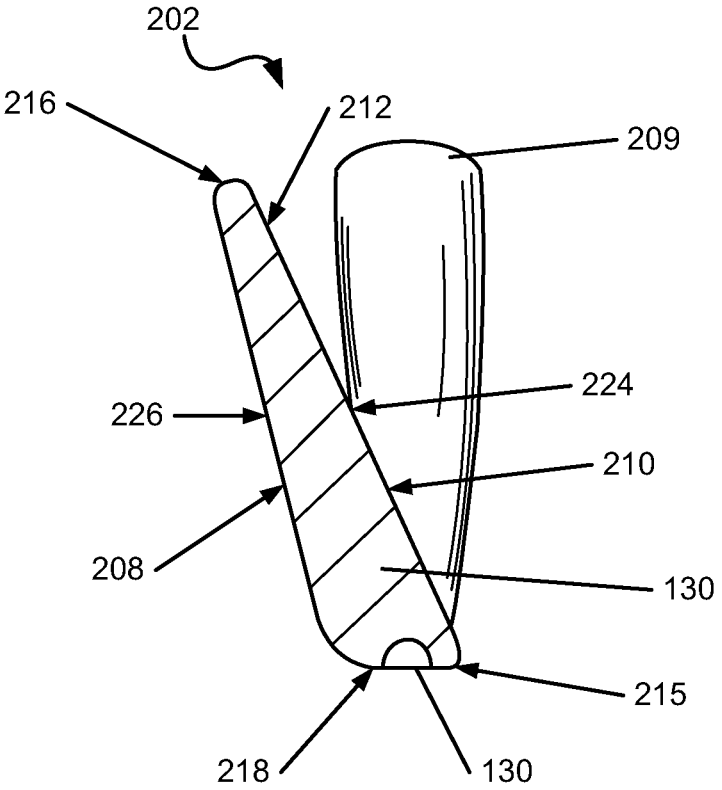
FIG. 27 is a side view of a ninth illustrative embodiment of a head of an iron-type ball striking device according to the present invention.
Figure 28:
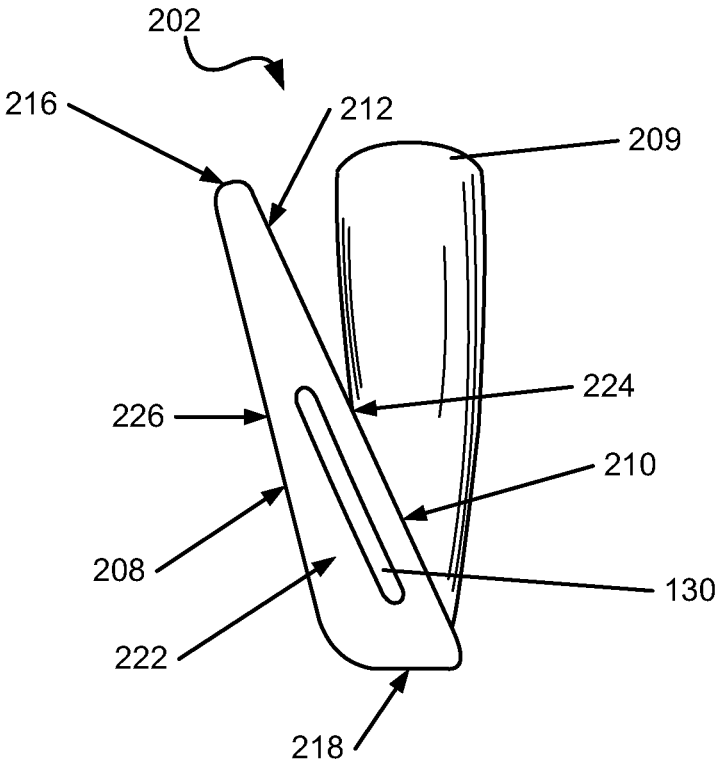
FIG. 28 is a cross-sectional view of a tenth illustrative embodiment of a head of an iron-type ball striking device according to the present invention.

FIGS. 27 and 28 illustrate additional embodiments of ball striking heads 202, containing channels 130 in the body 208 of the head 202, rather than in the face 212. FIG. 27 illustrates an embodiment that includes a channel 130 in the sole 218 of the head 202. Although not shown in FIG. 27, the channel 130 in this embodiment may extend parallel or generally parallel to the lower edge 215 of the face 212. The channel 130 causes the region of highest response to be directionally enlarged toward the bottom edge 215 of the face 212 in this embodiment. FIG. 28 illustrates an embodiment that includes a channel 130 in the side of the heel 222 portion of the body 208. In this embodiment, the channel 130 extends parallel or generally parallel to one of the lateral edges 227 (not shown in FIG. 28) of the face 212. The channel 130 causes the region of highest response to be directionally enlarged toward the toe 222 of the head 202 in this embodiment. The channels 130 in FIGS. 27-28 are shown as containing no flexible material 144, however these channels 130 may contain a flexible material 144 in other embodiments. It is understood that other channels 130 may be additionally or alternately positioned in other locations on the head 202, to directionally enlarge the region of highest response in a different manner. The heads 202 in FIGS. 27-28 are shown and described as heads 202 for use with iron-type ball striking devices 200. However, it is understood that the features of FIGS. 27-28 can be utilized in other types of ball striking devices, such as a wood-type ball striking device 100 as shown in FIGS. 1-16A and described above. It is also understood that the channels 130 in the sides of the head 202 may be utilized in a ball-striking head 102, 202 in addition or complement to channels 130 in the face 112, 212, including in any of the configurations and embodiments described above and shown in FIGS. 2-16A and 18-26.

Several different embodiments have been described above, including the embodiments shown in FIGS. 2-16A and 18-28. It is understood that any of the features of these various embodiments may be combined and/or interchanged. For example, a face 112, 212 may have one or more channels 130 that extend transverse or substantially transverse to adjacent outer edges 127, 227 of the face 112, 212 and one or more additional channels 130 that extend generally parallel to adjacent outer edges 127, 227 of the face 112, 212. As another example, a face 112, 212 may have a combination of channels 130 that extend to the edges 127, 227 of the face 112, 212, channels 130 that extend past the edges 127, 227 and into the body 108, 208, and/or channels 130 that stop short of the adjacent edges 112, 212. Still further, all of the embodiments illustrated in FIGS. 2-16A and 18-28 contain channels 130 in the outer (ball striking) surface 110 of the face 112. However, in other embodiments, the inner surface 111 may additionally or alternately contain one or more channels 130 with similar structure and function to those described herein, as described above and shown in FIGS. 14A and 16A. It is understood that in some embodiments, one or more of the channels 130 may not extend along a linear path, and may be curvilinear, such as the channels 130 shown in FIG. 5, and/or that one or more of the channels 130 may not be elongated in an identifiable direction.

The channel(s) 130 can be formed in the face 112, 212 in a variety of different ways. In one embodiment, one or more channels 130 can be formed in the face 112, 212 after the face 112, 212 has been manufactured, such as by cutting, milling, forging, or other such technique. It is understood that, in a multi-piece head 102, 202, the channels 130 can be formed in the face 112, 212 either before or after the head 102 has been fully assembled. In another embodiment, one or more channels 130 can be formed during manufacture of the face 112, 212, such as by creating tooling for molding, forging, etc., that forms the channels 130 integrally with the face 112, 212. In further embodiments, the channels 130 can be formed using any other suitable technique. Additionally, one or more channels 130 may be filled with a flexible material 144, such as described above, which may be performed in a variety of different ways. For example, the flexible material 144 may be inserted into the channel(s) 130 in a solid state, and can be held within the channel 130 using welding, brazing, soldering, an adhesive, an interference fit, a fastener, or other suitable technique. As another example, the flexible material 144 may be inserted into the channel(s) in a completely or partially liquid state, such as by filling the channel(s) 130 with a molten material or reagent materials which react to form the flexible material (e.g. through a chemical or polymerization reaction). As a further example, the flexible material 144 can be filled into the channel(s) in the course of manufacturing the face 112, 212. In still further embodiments, the channels 130 can be filled with the flexible material 144 using any other suitable technique.

Heads 102, 202 incorporating the channels 130 disclosed herein may be used as a ball striking device or a part thereof. For example, a golf club 100, 200 as shown in FIGS. 1 and 17 may be manufactured by attaching a shaft or handle 104, 204 to a head that is provided, such as the head 102, 202 as described above. "Providing" the head, as used herein, refers broadly to making an article available or accessible for future actions to be performed on the article, and does not connote that the party providing the article has manufactured, produced, or supplied the article or that the party providing the article has ownership or control of the article. In other embodiments, different types of ball striking devices can be manufactured according to the principles described herein. Manufacturing the head 102 shown in FIGS. 11-16A may include attachment of a backbody member 129 to a face frame member 128, as described above. Additionally, the head 102, 202, golf club 100, 200, or other ball striking device may be fitted or customized for a person by forming one or more channels 130 in the face 112, 212, such as by a technique described above, to achieve a desired size and configuration of the region of highest response 140 of the face 112, 212. Such customization may include cutting, milling, or otherwise forming one or more channels 130 in the face 112, 212, and/or filling one or more channels 130 with a flexible material.

The ball striking devices and heads therefor as described herein provide many benefits and advantages over existing products. One or more channels 130 can be formed in the face 112, 212 of a golf club head 102, 202 to create a region of highest COR response 140 having a desired size and/or shape, at advantageous locations on the face, to provide greater response and increased energy transfer during impacts in such locations. As one example, the size and shape of the region 140 can be designed to correspond to locations where off-center impacts frequently occur for typical golfers. One such configuration is shown in FIG. 2, in which the region of highest response 140 is enlarged toward the high-toe area 162 and low-heel area 164 of the face 112, where missed hits frequently occur for many golfers. As a result, impacts in these areas will transfer more energy to the ball. This configuration is shown for use in a wood-type golf club head 102, and may provide advantages for use in a wood-type club head 102. However, this configuration may also provide advantages for use in an iron-type head 202, as shown in FIG. 24. The same is true for other configurations, such as those shown in FIGS. 3-10, 18-23, and 25. As another example, the size and shape of the region 140 can be customized to correspond to locations where off-center impacts frequently occur for an individual golfer. As a further example, the size and shape of the region 140 can be designed to improve the performance of the club head 102, 202. For example, in an iron-type club head 202, ball impacts frequently occur lower than the center of the face 202. The configuration shown in FIG. 18 has a region of highest response 140 that is enlarged below the center of the face 212, so that impacts in this area will result in more energy transfer to the ball. This configuration is shown for use in an iron-type golf club head 202, and may provide advantages for use in an iron-type club head 202. However, this configuration may also provide advantages for use in a wood-type head 102, as shown in FIG. 8. The same is true for other configurations, such as those shown in FIGS. 2-7, 9-10, and 19-25. Similarly, the region of highest response 140 can be enlarged to adapt the face 112, 212 for different hitting conditions. For example, when hitting a ball in long rough or off a tee, the ball is typically hit higher on the face 112, 212, and in shorter grass, the ball is typically hit lower on the face 112, 212, and the club head 102, 202 can be adapted for any one or more of these conditions, as described above. Further benefits and advantages are recognized by those skilled in the art.

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims.

What is claimed is:

1. An iron-type golf club head comprising:

an iron-type face having an outer surface on a front side of the head, the face being defined by peripheral edges and having a region of highest response;

an iron-type golf club body connected to the face and extending rearward from the peripheral edges of the face, the body having a top, a sole, a heel, and a toe;

an elongated sole channel located on the sole of the body and extending generally parallel to a bottom peripheral edge of the face;

a first channel formed in the outer surface and extending inwardly from the outer surface, the first channel located on a heel area of the face, the first channel having a first end located on a bottom area of the face and spaced from the bottom peripheral edge of the face, the first channel extending upwardly toward a top peripheral edge of the face and having a second end more proximate the top peripheral edge of the face relative to the first end, wherein the first channel is not located in the region of highest response of the face, and wherein the first channel is not exposed on a rear side of the head opposite the front side; and a second channel formed in the outer surface and extending inwardly from the outer surface, the second channel located on a toe area of the face, the second channel having a first end located on a bottom area of the face and spaced from the bottom peripheral edge of the face, the second channel extending upwardly toward a top peripheral edge of the face and having a second end more proximate the top peripheral edge of the face relative to the first end, wherein the second channel is not located in the region of highest response of the face, and wherein the second channel is not exposed on a rear side of the head opposite the front side.

2. The iron-type golf club head of claim 1, wherein the sole channel comprises an elongated recess in the sole.

3. The iron-type golf club head of claim 1, wherein the first and second channels and the sole channel are all at least partially filled with a flexible material having a flexibility that is greater than a flexibility of a material of the face.

4. The iron-type golf club head of claim 1, wherein the first and second channels are both completely filled with a flexible material.

5. The iron-type golf club head of claim 1, wherein no portion of the first and second channels extends to within a distance of 1.5 inch from a geometric center of the face.

6. The iron-type golf club head of claim 1, wherein the outer surface of the face includes a ball striking surface configured for striking a ball and having face grooves, and wherein the first and second channels are both located on the ball striking surface and intersect the face grooves.

7. The iron-type golf club head of claim 1, wherein the region of highest response of the face is directionally enlarged toward the first channel and the second channel, and wherein the sole channel causes the region of highest response of the face to be directionally enlarged toward the bottom peripheral edge of the face.

8. The iron-type golf club head of claim 1, wherein the first and second channels have consistent depth.

9. An iron-type golf club head comprising:

an iron-type face having an outer surface on a front side of the head, the face being defined by peripheral edges and having a geometric center;

an iron-type golf club body connected to the face and extending rearward from the peripheral edges of the face, the body having a top, a sole, a heel, and a toe, the body further having a rear cavity in a rear side of the head opposite the front side;

an elongated sole channel located on the sole of the body and extending generally parallel to a bottom peripheral edge of the face;

a first elongated channel formed in the outer surface and extending inwardly from the outer surface, the first channel having a first end located in a low-heel area of the face and spaced from the bottom peripheral edge of the face, the first channel extending upwardly toward a top peripheral edge of the face and having a second end more proximate the top peripheral edge of the face relative to the first end, and wherein the first channel is not exposed on the rear side of the head; and a second elongated channel formed in the outer surface and extending inwardly from the outer surface, the second channel having a first end located in a low-toe area of the face and spaced from the bottom peripheral edge of the face, the second channel extending upwardly toward a top peripheral edge of the face and having a second end more proximate the top peripheral edge of the face relative to the first end, and wherein the second channel is not exposed on the rear side of the head, wherein no portion of the first and second channels extends to within a distance of 1.5 inches from a geometric center of the face.

10. The iron-type golf club head of claim 9, wherein the first and second channels and the sole channel all contain a flexible material having a flexibility that is greater than a flexibility of a material of the face.

11. The iron-type golf club head of claim 9, wherein the outer surface of the face includes a ball striking surface configured for striking a ball and having face grooves, and wherein the first and second channels are both located on the ball striking surface and intersect the face grooves.

12. The iron-type golf club head of claim 9, wherein the first and second channels are elongated and oriented to be generally parallel with each other.

13. The iron-type golf club head of claim 9, wherein the first and second channels are elongated and oriented at angles of less than or equal to 90 degrees at their virtual intersection point.

14. An iron-type golf club head of claim 9, wherein the first and second channels are elongated and oriented at oblique angles of greater than 90 degrees.

15. An iron-type golf club head of claim 9, wherein the first and second channels have consistent depth.

16. An iron-type golf club head comprising:

an iron-type face having an outer surface on a front side of the head, the face being defined by peripheral edges and having a region of highest response;

an iron-type golf club body connected to the face and extending rearward from the peripheral edges of the face, the body having a top, a sole, a heel, and a toe, the body further having a rear cavity in a rear side of the head opposite the front side, such that an inner surface of the face is located within the rear cavity;

a first channel formed in the outer surface and extending inwardly from the outer surface, the first having a first end located in low-heel area of the face and spaced from a bottom peripheral edge of the face, the first channel extending upwardly toward a top peripheral edge of the face and having second end more proximate the top peripheral edge of the face relative to the first end, and wherein the first channel is not exposed on the rear side of the head; and a second channel formed in the outer surface and extending inwardly from the outer surface, the second channel having a first end located in low-toe area of the face and spaced from a bottom peripheral edge of the face, the second channel extending upwardly toward a top peripheral edge of the face and having second end more proximate the top peripheral edge of the face relative to the first end, and wherein the second channel is not exposed on the rear side of the head, wherein the first channel and the second channels are elongated and oriented to be generally parallel to each other, wherein the first and second channels are both filled with a flexible material having a flexibility that is greater than a flexibility of a material of the face, and wherein the first channel is not located in the region of highest response of the face, and no portion of the first and second channels extends to within a distance 1.5 inches from a geometric center of the face.

17. The iron-type golf club head of claim 16, further comprising an elongated sole channel located on the sole of the body and extending generally parallel to a bottom peripheral edge of the face.

18. The iron-type golf club head of claim 16, wherein the sole channel is at least partially filled with the flexible material.

19. The iron-type golf club head of claim 16, wherein the first and second channels have consistent depth.

20. The iron-type golf club head of claim 16, wherein the first and second channels have varying depth.

* * * * *